US006315289B1

(12) United States Patent
Sakamoto et al.

(10) Patent No.: US 6,315,289 B1
(45) Date of Patent: Nov. 13, 2001

(54) GAME MACHINE INFORMING SMALL HIT PRIZE

(75) Inventors: Yoshikazu Sakamoto; Hiroshi Yoshida, both of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/395,770

(22) Filed: Sep. 14, 1999

(30) Foreign Application Priority Data

Nov. 26, 1997 (JP) ..... 9-340746
Sep. 14, 1998 (JP) ..... 10-260071

(51) Int. Cl.[7] ..... A63F 9/24
(52) U.S. Cl. ..... 273/121 B; 463/20
(58) Field of Search ..... 463/16, 20; 273/138.1, 273/121 B, 143 R

(56) References Cited

U.S. PATENT DOCUMENTS

| | | | | |
|---|---|---|---|---|
| 4,618,150 | | 10/1986 | Kimura . | |
| 4,624,459 | | 11/1986 | Kaufman . | |
| 5,024,439 | * | 6/1991 | Okada | 273/143 R |
| 5,695,188 | * | 12/1997 | Ishibashi | 273/143 R |
| 5,713,572 | | 2/1998 | Hagiwara . | |
| 5,803,451 | | 9/1998 | Kelly et al. . | |
| 5,848,932 | * | 12/1998 | Adams | 463/20 |
| 5,954,422 | * | 9/1999 | Marchini et al. | 362/227 |
| 6,056,642 | * | 5/2000 | Bennett | 463/20 |

FOREIGN PATENT DOCUMENTS

| | | | | |
|---|---|---|---|---|
| 38 30 648 | | 3/1990 | (DE) . | |
| 0 391 667 | | 10/1990 | (EP) . | |
| 0 414 427 | | 2/1991 | (EP) . | |
| 0 720 129 | | 7/1996 | (EP) . | |
| 0 875 870 | | 11/1998 | (EP) . | |
| 0875870A2 | * | 4/1998 | (EP) | G07F/17/32 |
| 2 057 738 | | 4/1981 | (GB) . | |
| 2 117 155 | | 10/1983 | (GB) . | |
| 2 147 442 | | 5/1985 | (GB) . | |
| 2 326 260 | | 12/1998 | (GB) . | |
| 62-127086 | | 6/1987 | (JP) . | |
| 9-271559 | | 10/1997 | (JP) . | |
| 9-309735 | | 10/1997 | (JP) . | |
| 10-33750 | | 2/1998 | (JP) . | |
| 10-272230 | | 10/1998 | (JP) . | |
| 10-305128 | | 11/1998 | (JP) . | |

* cited by examiner

*Primary Examiner*—Valencia Martin-Wallace
*Assistant Examiner*—Julie Kasick

(57) ABSTRACT

A conventional game machine informs a player that a big hit prize is caused by inner lottery, however, it does not inform the player that a small hit prize is caused. Prize determination (probability lottery processing) is carried out by determining to which prize group in a prize determining table a random number value generated by a random number generator 36 and specified by a sampling circuit 37 pertain (step 103). When a hit flag of a small hit prize is erected as a result of the inner lottery (step 104), a process of emitting small hit informing sound is carried out (step 105). According to the informing sound emitting processing, a speaker drive circuit 43 is controlled by CPU 31 and the speaker 39 emits informing sound A, B, C and D in accordance with the kind of the hit flag of the small hit prize.

8 Claims, 22 Drawing Sheets

— Prior Art —

Fig. 7

| Hit / No. of coins | Big | Medium | Small | | | | |
|---|---|---|---|---|---|---|---|
| | BB | RB | Water melon | Bell | 4 Cherry | 2 Cherry | Replay |
| 1 | a 1 | b 1 | c 1 | d 1 | e 1 | f 1 | g 1 |
| 2 | a 2 | b 2 | c 2 | d 2 | e 2 | f 2 | g 2 |
| 3 | a 3 | b 3 | c 3 | d 3 | e 3 | f 3 | g 3 |

Fig. 8

| Code No. | #1 reel | #2 reel | #3 reel |
|---|---|---|---|
| 0 | A | E | B |
| 1 | G | C | H |
| 2 | F | D | F |
| 3 | C | G | E |
| 4 | F | D | F |
| 5 | A | A | A |
| 6 | D | E | E |
| 7 | C | G | F |
| 8 | G | D | D |
| 9 | F | E | F |
| 10 | C | B | H |
| 11 | F | D | B |
| 12 | A | E | F |
| 13 | E | D | E |
| 14 | C | A | F |
| 15 | F | E | H |
| 16 | B | G | C |
| 17 | F | D | F |
| 18 | C | B | D |
| 19 | E | F | E |
| 20 | F | D | F |

Fig.11A Small prize hit informing sound

Fig. 11B Reel rotation inhibit sound

Fig. 11C Final stop reel

Fig. 11D Start lever

Fig. 11E Lottery timing

| Hit flag | BB | RB | Water melon | Bell | 4 Cherry | 2 Cherry | Replay | Blank |
|---|---|---|---|---|---|---|---|---|
| Hit section Data | 0~200 (a3=201) | 201~380 (b3=381) | 381~800 (c3=801) | 801~1900 (d3=1901) | 1901~4000 (e3=4001) | 4001~10000 (f3=10001) | 10001~18000 (g3=18001) | 18001~65535 |
| Inform section Data | 0~150 20000~20200 | 201~340 20201~20380 | 381~770 20381~20800 | 801~1800 20801~21900 | 1901~3500 21901~24000 | 4001~9000 24001~30000 | 10001~17500 30001~38000 | 38001~65535 |

Fig. 12

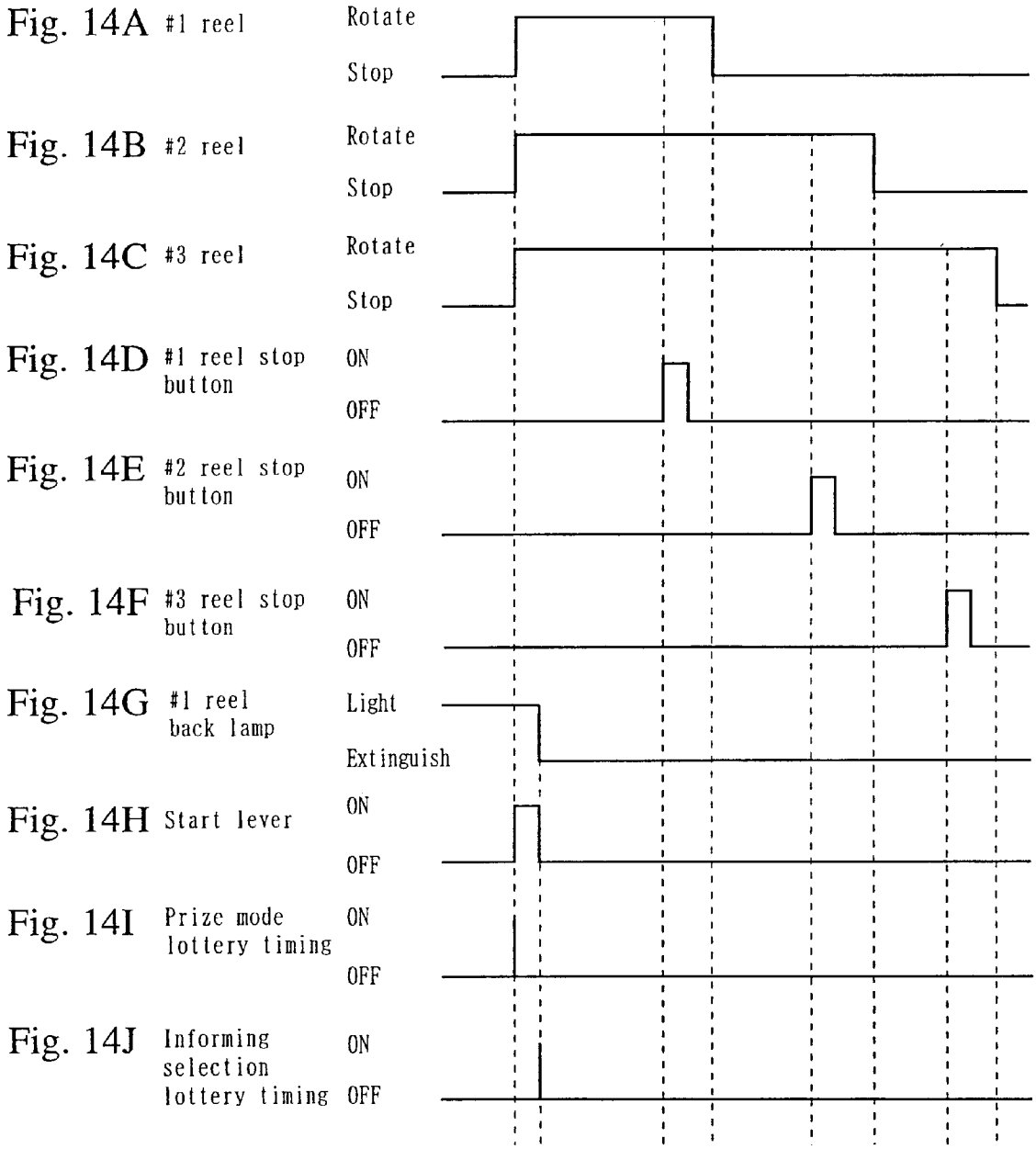
Fig. 14A #1 reel
Rotate
Stop
Fig. 14B #2 reel
Rotate
Stop
Fig. 14C #3 reel
Rotate
Stop
Fig. 14D #1 reel stop button
ON
OFF
Fig. 14E #2 reel stop button
ON
OFF
Fig. 14F #3 reel stop button
ON
OFF
Fig. 14G #1 reel back lamp
Light
Extinguish
Fig. 14H Start lever
ON
OFF
Fig. 14I Prize mode lottery timing
ON
OFF
Fig. 14J Informing selection lottery timing
ON
OFF

Fig. 16

| GMLVSTS | FLGCTR | Table No. |
|---|---|---|
| in RB operation | Blank | 17 |
| | Hit | 17 |
| in BB operation | Blank | 17 |
| | 2 Cherry | 13 |
| | 4 Cherry | 14 |
| | Bell | 15 |
| | Watermelon | 16 |
| | Replay | 0 |
| in General game | Blank | 17 |
| | 2 Cherry | 1 |
| | 4 Cherry | 2 |
| | Bell | 3 |
| | Watermelon | 4 |
| | Replay | 0 |
| | RB | 0 |
| | BB | 0 |
| in inner hit of RB | Blank | 17 |
| | 2 Cherry | 5 |
| | 4 Cherry | 6 |
| | Bell | 7 |
| | Watermelon | 8 |
| | Replay | 0 |
| in inner hit of BB | Blank | 17 |
| | 2 Cherry | 9 |
| | 4 Cherry | 10 |
| | Bell | 11 |
| | Watermelon | 12 |
| | Replay | 0 |

Fig. 17

| Talbe No. | Lottery value | Reel lamp extinguish |
|---|---|---|
| No. 0 | 100 | No |
| | 9 | 1 |
| | 8 | 2 |
| | 3 | 3 |
| | 8 | 4 |
| No. 1 | 93 | 1 |
| | 26 | No |
| | 4 | 2 |
| | 5 | 3 |
| No. 2 | 3 | No |
| | 10 | No |
| | 5 | 1 |
| | 49 | 2 |
| | 30 | No |
| | 1 | No |
| | 30 | 3 |
| No. 3 | 70 | 3 |
| | 18 | No |
| | 30 | No |
| | 2 | 1 |
| | 8 | 2 |
| No. 4 | 60 | 4 |
| | 42 | No |
| | 14 | 3 |
| | 12 | 3 |
| No. 5 | 97 | 1 |
| | 18 | 1 |
| | 8 | 2 |
| | 3 | 3 |
| | 2 | 3 |
| No. 6 | 36 | 2 |
| | 26 | No |
| | 20 | 3 |
| | 10 | 3 |
| | 18 | No |
| | 7 | 3 |
| | 7 | 3 |
| | 4 | 4 |

Fig. 18

| | | |
|---|---|---|
| No. 7 | 55 | 3 |
| | 9 | 3 |
| | 12 | 3 |
| | 22 | No |
| | 6 | 3 |
| | 6 | 4 |
| | 18 | 3 |

| | | |
|---|---|---|
| No. 8 | 77 | 4 |
| | 6 | 1 |
| | 16 | 3 |
| | 16 | 3 |
| | 10 | 3 |
| | 3 | 3 |

| | | |
|---|---|---|
| No. 9 | 40 | 1 |
| | 20 | 1 |
| | 13 | 3 |
| | 36 | No |
| | 10 | 1 |
| | 9 | 3 |

| | | |
|---|---|---|
| No. 10 | 10 | 3 |
| | 50 | No |
| | 68 | 2 |

| | | |
|---|---|---|
| No. 11 | 38 | 3 |
| | 38 | 3 |
| | 24 | No |
| | 14 | 1 |
| | 7 | 2 |
| | 7 | 4 |

| | | |
|---|---|---|
| No. 12 | 37 | 4 |
| | 35 | 4 |
| | 28 | No |
| | 4 | 3 |
| | 14 | 3 |
| | 10 | 3 |

Fig. 19

| | | |
|---|---|---|
| No. 13 | 50 | 1 |
| | 8 | 2 |
| | 18 | 1 |
| | 14 | 3 |
| | 12 | 3 |
| | 16 | No |
| | 10 | 4 |

| | | |
|---|---|---|
| No. 14 | 80 | 2 |
| | 7 | 1 |
| | 15 | No |
| | 17 | 3 |
| | 2 | 3 |
| | 7 | 3 |

| | | |
|---|---|---|
| No. 15 | 42 | 3 |
| | 38 | 3 |
| | 48 | 1 |

| | | |
|---|---|---|
| No. 16 | 30 | No |
| | 32 | 4 |
| | 16 | 1 |
| | 2 | 3 |
| | 38 | No |
| | 10 | 3 |

| | | |
|---|---|---|
| No. 17 | 128 | No |

Fig. 20A

| GMLVSTS | | |
|---|---|---|
| Content | | Data |
| bit 7 | Not used | Normally 0 |
| 6 | | |
| 5 | | |
| 4 | in inner hit of BB | 0:off 1:on |
| 3 | in inner hit of RB | 0:off 1:on |
| 2 | in general game | 0:off 1:on |
| 1 | in BB operation | 0:off 1:on |
| 0 | in RB operation | 0:off 1:on |

Fig. 20B

| FLGCTR | |
|---|---|
| Content | Data |
| in blank | 0 0 H |
| in hit of 2 cherry | 0 1 H |
| in hit of 4 cherry | 0 2 H |
| in hit of bell | 0 3 H |
| in hit of watermelon | 0 4 H |
| in hit of replay | 0 5 H |
| in hit of RB | 0 6 H |
| in hit of BB | 0 7 H |

GAME MACHINE INFORMING SMALL HIT PRIZE

This patent application claims priority based on the Japanese patent application, H10-260071 filed on Sep. 14, 1998 the content of which is incorporated herein by reference.

BACKGROUND OF THE INVENTION

1. Field of the Invention

The present invention relates to a game machine in which prize mode is determined by random number lottery and a small hit prize is caused.

2. Description of the Related Art

There has conventionally been, for example, a slot machine as a game machine of this kind. In a general slot machine, as shown by FIG. 1A, three reels 3, 4 and 5 are installed in parallel on a rear side of a front panel 2. Various patterns are illustrated on outer peripheries of the respective reels 3 through 5, and the patterns are illuminated from behind by built-in light sources (back lights), not illustrated, installed at the respective reels and are observed via respective windows 6, 7 and 8 formed at the front panel 2. Five prize lines are described in the windows and the slot machine game is carried out in accordance with whether a combination of predetermined patterns is set on any of the prize lines.

The game is started when a player puts a coin into a slot and when the coin is put into the slot, as shown by FIG. 1A, all of the back lights are lighted. When a coin of the player has not been put thereinto by the player for a constant time period after finishing the game, or the like, all of the back lights are extinguished as shown by FIG. 1B. The respective reels 3 through 5 are rotated in accordance with operation of a start lever by the player and the respective windows 6 through 8 are displayed with the patterns which move to rotate in directions of columns thereof. When the respective reels 3 through 5 reach a constant speed, operation of respective stop buttons installed in correspondence with the respective reels 3 through 5 becomes effective.

The player operates the respective stop buttons while observing the moving patterns and stops rotation of the respective reels 3 through 5 to thereby stop and display desired patterns on any of the prize lines. The respective reels 3 through 5 stop rotating in accordance with operational timings of the respective stop buttons. When a predetermined combination of patterns is displayed on any of the prize lines in stopping them, a prize in accordance with the combination of patterns is obtained.

There are a big hit prize, a medium hit prize, a small hit prize and so on in prize modes and the big hit prize or the medium hit prize is caused when three of patterns "7" or patterns of a predetermined character are set on the prize line. A special game of big bonus game (BB game) in the case of the big hit prize or regular bonus game (RB game) in the case of the medium hit prize is carried out and a large amount of coins can be acquired. Further, the small hit prize is caused when three of patterns of, for example, "cherry" or "bell" are aligned on the prize line and several coins can be acquired in the small hit prize. FIG. 1C shows a case in which patterns "bell" are aligned on a central prize line and in this case, back lights are caused to blink.

Such prize modes are determined by a lottery of random numbers which is carried out immediately after operating the start lever and has already been determined before the respective reels are operated to stop by the player. The lottery of random numbers is executed by prize mode determining means constituted inside the game machine. When the big hit prize is determined by the lottery of random numbers, a lamp installed at the front panel of the machine is lighted and the player is informed of the fact that the big hit prize is caused by the inner lottery of the machine. Thereafter, rotation of the respective reels is controlled to stop in accordance with the operation of the stop buttons by the player and the prize is caused when a combination of patterns of the prize determined by the lottery of random numbers is stopped and displayed on the prize line.

However, according to the conventional game machine, although the player is informed of the fact that a big hit prize is caused by the inner lottery, the player is not informed on the fact that a small hit prize is caused by the inner lottery. There fore, the player does not know that the small hit prize has been determined by random number lottery inside the machine until patterns are actually stopped and displayed at the respective windows. Therefore, when a small hit prize is determined by the inner lottery, the player cannot know in advance the result of the inner lottery and accordingly, when the player initially operates to stop rotation of the reel, the player cannot know which patterns may be aligned on the prize line.

Further, according to the above-described conventional game machine, the player is informed of a result of the inner lottery in which a big hit prize is caused by simply lighting the lamp and accordingly, there is no interest created in the game.

SUMMARY OF THE INVENTION

The present invention has been carried out in order to address such a problem and is characterized in that in a game machine having prize mode determining means for determining a prize mode of a game by a random number lottery, the game machine comprises informing means for informing a player that a small hit prize is determined by the prize mode determining means.

According to the invention, the player can know in advance that the small hit prize is caused by the inner lottery and can easily carry out the stopping operation.

Further, the present invention is characterized in that the player is also informed of the kind of the small hit prize. For example, the kind of the small hit prize is informed to the player by emitting a plurality of kinds of sound.

According to the invention, the player can previously know the kind of the small hit prize and can carry out the button stopping operation easily.

Further, the present invention is characterized in that when the small hit prize is determined by the prize mode determining means, the informing means announces the small hit prize to the player with a predetermined probability. Further, the present invention is characterized in that the small hit prize is announced to the player with the predetermined probability even when a prize mode other than the small hit prize is determined by the prize mode determining means.

According to the invention, there is a case in which the small hit prize mode is informed to the player and there is a case in which the small hit prize mode is not informed to the player. Further, the small hit prize mode is informed with the predetermined probability even when the prize mode other than the small hit prize is determined by the prize mode determining means. Therefore, information of the small hit prize mode is expected by the player and when the result of the inner lottery is announced, pleasure of the player is enhanced and enjoyment of the game is promoted.

That is, according to the invention, the player can know in advance that a small hit prize is caused by the inner lottery by the informing sound emitted by the informing means or lighting the reel back lamps which the informing means controls to light and therefore, the player can easily carry out the button stopping operation. Further, by constructing the constitution in which the informing means also informs the kind of the small hit prize to the player, the button stopping operation can further easily be carried out by the player. Further, when the small hit prize is announced in advance, a player can enjoy the game by hearing the informing sound or looking at a display mode of lamp, and enjoyment of the game is enhanced. Further, by constructing the constitution in which the player is informed at the predetermined probability, when the player is informed of a prize, pleasure of the player is enhanced and enjoyment of the game is further promoted.

BRIEF DESCRIPTION OF THE DRAWINGS

FIG. 7 is a diagram showing a prize probability table used in a game process of the slot machine according to the first, the second and the third respective embodiments of the present invention.

FIG. 8 is a diagram showing a symbol table used in a game process of the slot machine according to the first, the second and the third respective embodiments of the present invention.

FIG. 12 is a diagram showing a prize mode informing selection lottery probability table used in a game process of the slot machine according to the second embodiment of the invention;

FIGS. 14A, 14B, 14C, 14D, 14E, 14F, 14G, 14H, 14I and 14J are timing chart diagrams showing timings of respective portions of circuits in a game process of the slot machine according to the second and the third respective embodiments of the invention;

FIG. 16 is a diagram showing a demonstration lottery table selecting table used in a game process of the slot machine according to the third embodiment of the invention;

FIG. 17 is a diagram showing a first demonstration lottery table used in a game process of the slot machine according to the third embodiment of the invention;

FIG. 18 is a diagram showing a second demonstration lottery table used in a game process of the slot machine according to the third embodiment of the invention;

FIG. 19 is a diagram showing a third demonstration lottery table used in a game process of the slot machine according to the third embodiment of the invention;

FIG. 20A is a diagram showing a content of a game level status (GMLVSTS) storing region stored in RAM of the slot machine according to the third embodiment and FIG. 20B is a diagram showing a content of a flag counter (FLGCTR) storing region stored in the RAM;

DETAILED DESCRIPTION OF THE PREFERRED EMBODIMENTS

Next, an explanation will be given of a first embodiment in which a game machine according to the present invention is applied to a slot machine.

Figure 1A:
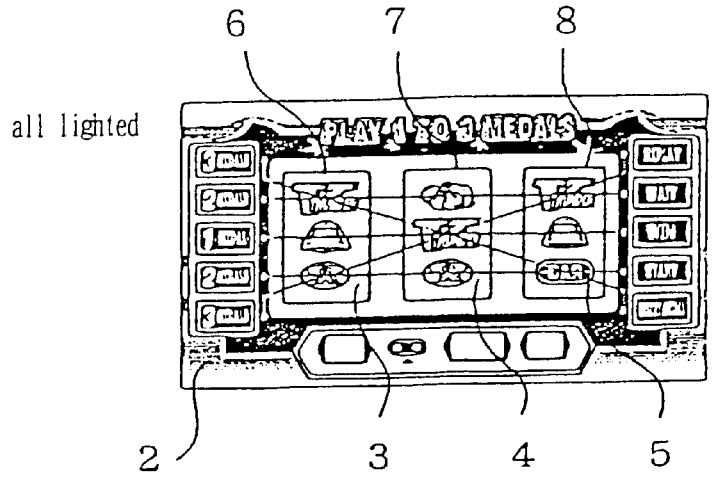
FIGS. 1A, 1B and 1C are views showing states of lighting respective reel back lamps in a conventional slot machine.
Figure 1B:
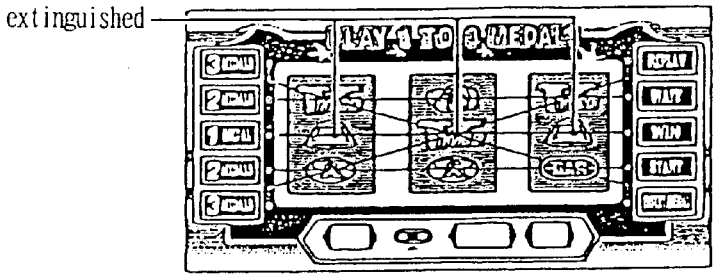
Figure 1C:
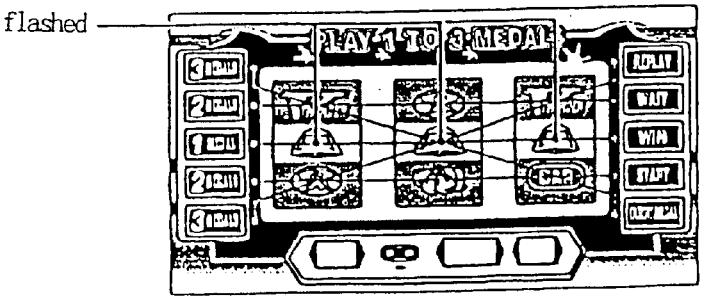
Figure 2:
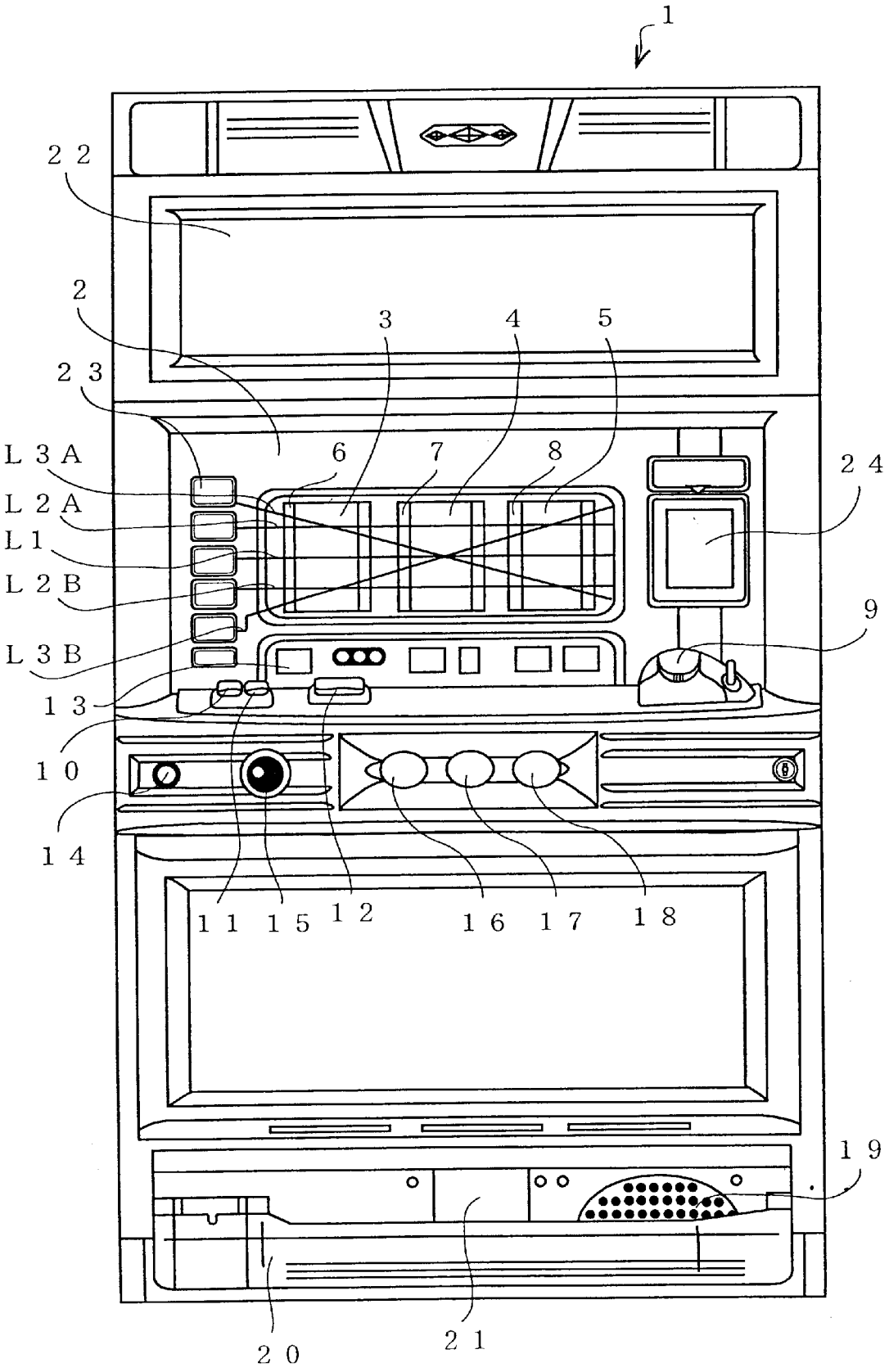
FIG. 2 is a front view showing an outlook of a slot machine according to a first, a second and a third respective embodiment of the present invention.

FIG. 2 is a front view of a slot machine 1 according to the embodiment.

Three reels 3, 4 and 5 constituting a variable display device are rotatably installed on a rear side of a front panel 2 of the slot machine 1. Columns of symbols comprising pluralities of kinds of patterns (hereinafter, referred to as symbol) are illustrated on outer peripheral faces of the respective reels 3, 4 and 5. Three of the symbols are observed via each of display windows 6, 7 and 8 at the front face of the slot machine 1. Further, a slot 9 into which a player inserts coins is installed on the lower right side of the display windows 6, 7 and 8.

Figure 3:
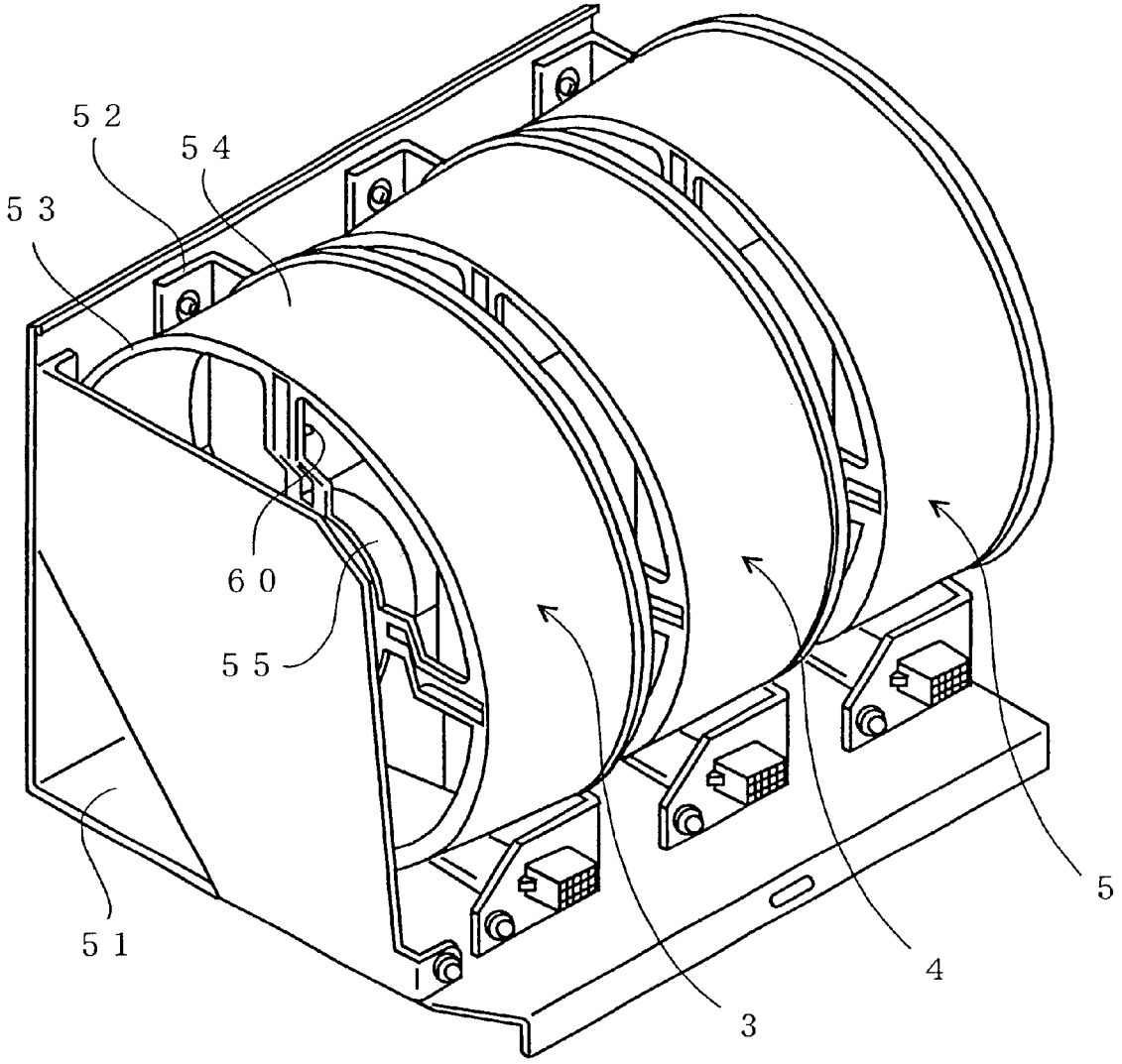
FIG. 3 is a perspective view showing a rotating reel unit of the slot machine shown by FIG. 2.

The respective reels 3 through 5 are constituted as a rotating reel unit shown by FIG. 3 and are attached to a frame 51 via brackets 52. Each of the reels 3 through 5 is constituted by pasting a reel band 54 on the outer periphery of a reel drum 53. The above-described symbol column is illustrated on the outer peripheral face of the reel band 54. Further, each of the brackets 52 is installed with a stepping motor 55 and the respective reels 3 through 5 are rotated by being driven by the motors 55.

Figure 4A:
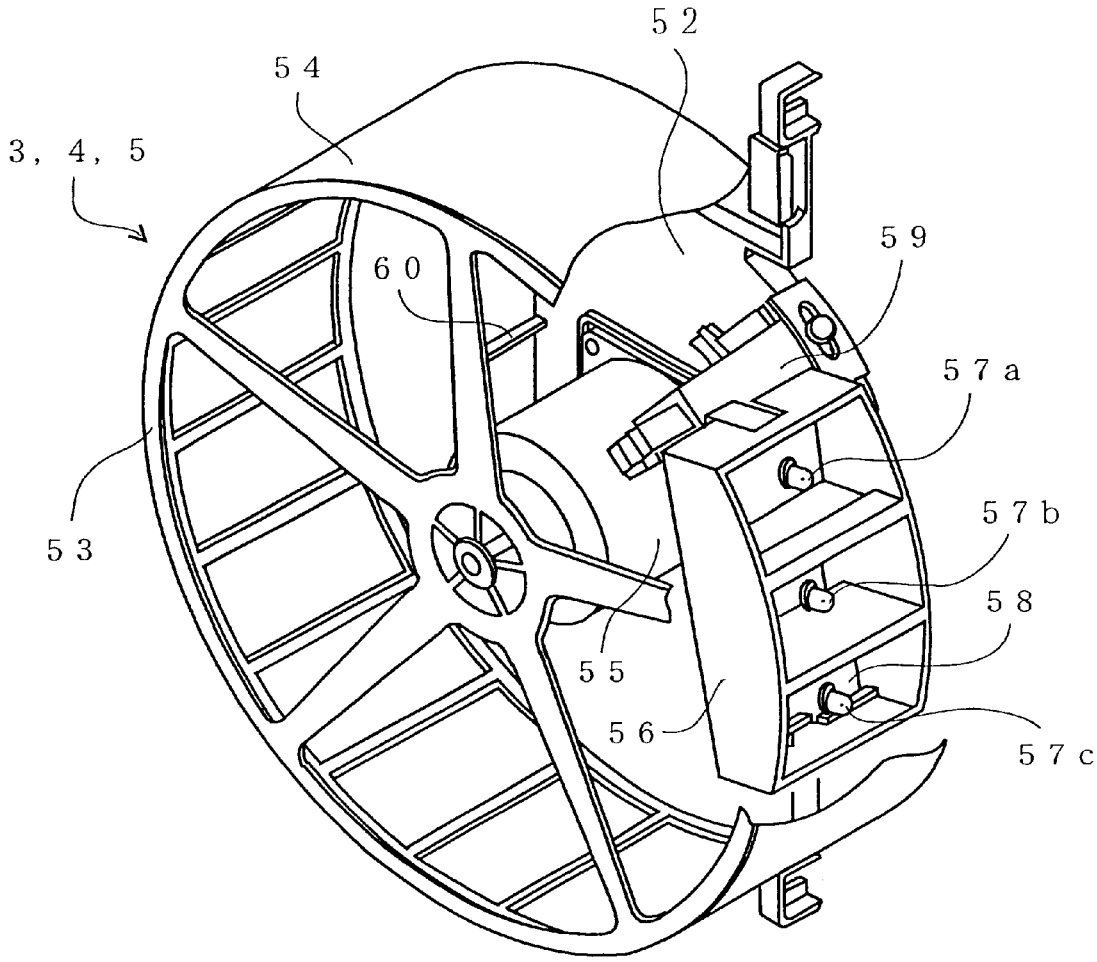
FIGS. 4A and 4B are perspective views showing a structure of a rotating reel constituting the rotating reel unit shown by FIG. 3.

FIG. 4*a* shows the structure of each of the respective reels 3 through 5. Further, portions of FIGS. 4A and 4B the same as those in FIG. 3 are attached with the same notations and an explanation thereof will be omitted. A lamp case 56 is installed inside the reel drum 53 on the rear side of the reel band 54 and back lamps 57*a*, 57*b* and 57*c* are respectively attached to three respective chambers of the lamp case 56.

Figure 4B:
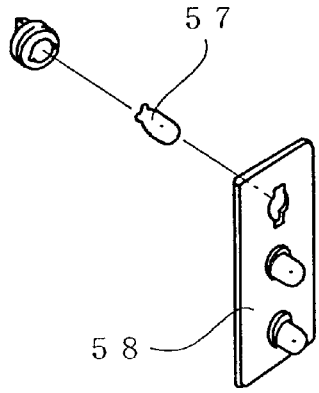

As shown by FIG. 4B, the back lamps 57*a*, 57*b* and 57*c* are mounted on a board 58 and the board 58 is attached to the rear side of the lamp case 56. A photosensor 59 is attached to the bracket 52. The photosensor 59 detects a shield plate 60 installed to the reel drum 53 to pass through the photosensor 59 in accordance with rotation of the reel drum 53.

The respective back lamps 57*a*, 57*b* and 57*c* are individually controlled to light by a lamp drive circuit 48, mentioned later. By lighting the respective back lamps 57*a*, 57*b* and 57*c*, three symbols disposed on the front side of the respective back lamps 57*a*, 57*b* and 57*c* among symbols illustrated on the reel bands 54 are individually lighted from the rear side and three symbols are projected on each of the respective display windows 6 through 8.

Figure 5A:
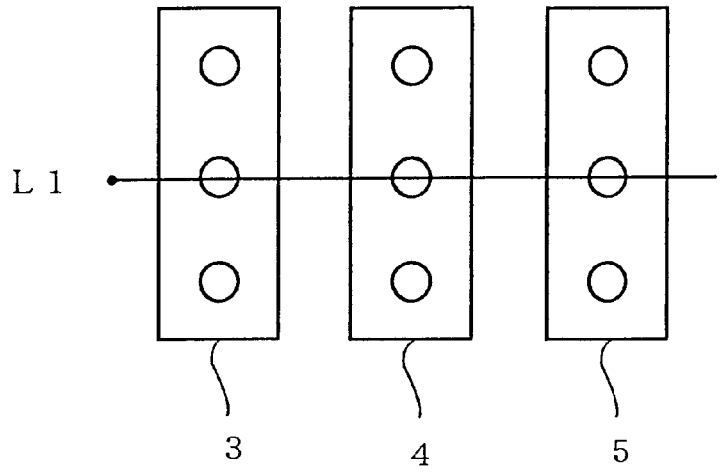
FIGS. 5A, 5B and 5C are views showing states in which prize lines described in display windows of the slot machine shown by FIG. 2 become successively effective.
Figure 5B:
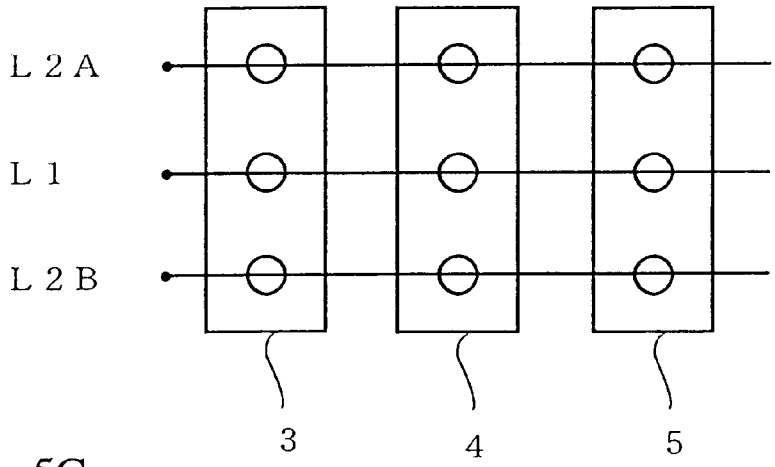

Further, the display windows 6 through 8 shown by FIG. 2 are described with prize lines of three horizontal lines (central line L1 and upper and lower lines L2A and L2B) as well as two skew lines (skew right downward line L3A and skew right upward line L3B). Before starting a game, when a player puts one sheet of coin into the coin slot 9, only the central prize line L1 on the respective reels 3 through 5 is made effective as shown by FIG. 5A. Further, when two sheets of coins are put into the slot 9, the upper and the lower prize lines L2A and L2B are added thereto and three horizontal lines of the prize lines L1, L2A and L2B are made effective as shown by FIG. 5B. Further, when three sheets of coins are put into the slot 9, all the prize lines L1, L2A, L2B, L3A and L3B are made effective as shown by FIG. 5C.

Figure 5C:
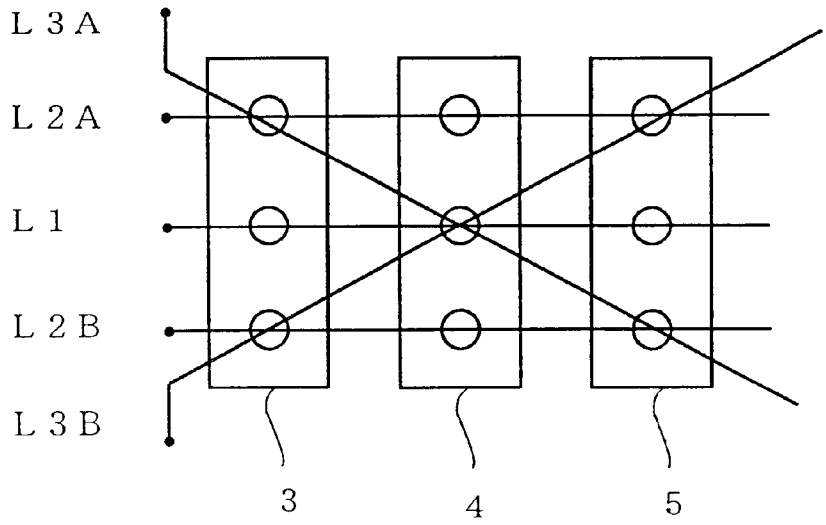

Further, circular marks in the FIGS. 5A, 5B and 5C represent symbols illustrated on the respective reels 3 through 5. The effectiveness of the prize line is displayed to the player by lighting effective line display lamps 23 (refer to FIG. 2) arranged at end portions of the respective prize lines.

Further, a 1BET switch 10, a 2BET switch 11 and a maxBET switch 12 are installed on the lower left side of the display windows 6 through 8. When coins are credited at a credit number display unit 13, instead of putting coins into the coin slot 9, by operating respective push buttons of the 1BET switch 10, the 2BET switch 11 and the maxBET switch 12, one sheet, two sheets and three sheets of coins are respectively betted in one game. The credit number display unit 13 is constituted by 7 segments LEDs (Light Emitting Diode) in accordance with a number of a digit of a displayed numerical value and displays a number of coins currently credited.

A credit/pay out switch (C/P switch) 14 and a start lever 15 are installed on the lower side of the BET switches 10 through 12 and stop buttons 16, 17 and 18 are installed at a central portion of the machine on the right side of the start lever 15. By operating the push button of the C/P switch 14, game credit/pay out of coins can be switched.

Further, by lever operation of the start lever 15, rotation of the reels 3, 4 and 5 is simultaneously started. The stop buttons 16, 17 and 18 are arranged in correspondence with the respective reels 3, 4 and 5. The operation of the respective stop buttons 16 through 18 is made effective when rotation of the respective reels 3 through 5 reaches a constant speed and rotation of the respective reels is stopped in accordance with push button operation of the player.

Further, a sound emitting hole 19 and a coin tray 20 are installed on the lower side of the front face of the slot machine 1. The sound emitting hole 19 is for emitting sound generated from a speaker contained inside the machine. The coin tray 20 is for storing coins paid out from a coin outlet 21. Further, a prize display portion 22 indicating how much coins are to be paid out according to the prize is installed on the upper side of the front face of the slot machine 1.

Further, a liquid crystal display unit 24 is installed at the front panel 2 on the right side of the respective reels 3, 4 and 5. The liquid crystal display unit 24 is a display device displaying rotation of the respective reels 3, 4 and 5, displaying the history of the game or carrying out a representation in a bonus game.

Figure 6:
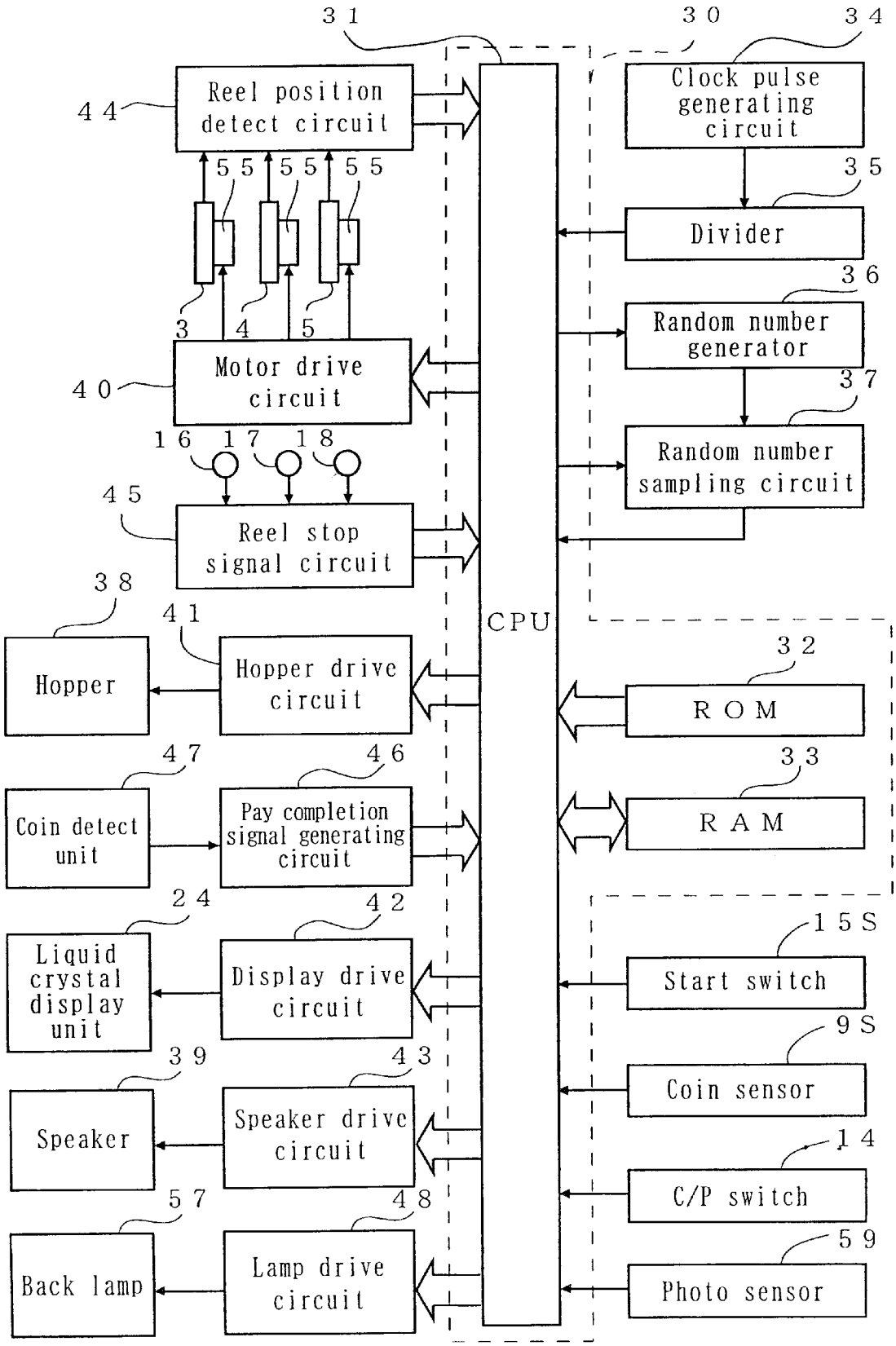
FIG. 6 is a block diagram showing a constitution of principal control circuits of the slot machine shown by FIG. 2.

FIG. 6 shows a circuit constitution including a control unit for controlling operation of game process in the slot machine 1 of the embodiment and peripheral devices (actuators) electrically connected thereto.

The control unit is constituted by a microcomputer (hereinafter, referred to as micon) 30 as a major constituent element and circuits for random number sampling in addition thereto. The micon 30 is constituted to include CPU 31 for carrying out a control operation in accordance with a previously set program, ROM 32 and RAM 33 as storing means. CPU 31 is connected with a clock pulse generating circuit 34 and a divider 35 for generating reference clock pulses, a random number generator 36 which is a random number generating means for generating random numbers in constant ranges and a random number sampling circuit 37 which is a random number sampling means for sampling an arbitrary random number among the generated random numbers.

As major actuators the operation of which are controlled by control signals from the micon 30, there are the respective stepping motors 55 for driving to rotate the reels 3, 4 and 5, a hopper 38 for containing coins, the liquid crystal display unit 24, a speaker 39 and the back lamps 57*a*, 57*b* and 57*c*. These are respectively driven by a motor drive circuit 40, a hopper drive circuit 41, a display drive circuit 42, a speaker drive circuit 43 and a lamp drive circuit 48. The drive circuits 40 through 43 and 48 are connected to CPU 31 via an I/O port of the micon 30. The respective stepping motors 55 are excited in 1 or 2 phase excitation by the motor drive circuit 40 and are respectively rotated by one rotation when drive signals of 400 pulses are supplied.

Further, as major input signal generating means for generating input signals necessary for forming control signals by the micon 30, there are a start switch 15S for detecting operation of the start lever 15, a coin input sensor 9S for detecting coins input from the coin slot 9 and the C/P switch 14 mentioned above. Also, there are the photosensor 59 and a reel position detect circuit 44 for detecting rotational positions of the respective reels 3, 4 and 5 by receiving an output pulse signal from the photosensor 59.

The photosensor 59 detects the shield plate 60 at each rotation of the respective reels 3, 4 and 5 and generates a reset pulse. The reset pulse is transmitted to CPU 31 via the reel position detect circuit 44. RAM 33 is stored with numerical values in correspondence with the rotational positions in a range of one rotation in respect of the reels 3 through 5 and when CPU 31 receives the reset pulse, CPU 31 clears the numerical values formed in RAM 33 to "0". By the clearing operation, a deviation caused between display of movement of each symbol and rotation of each stepping motor 55 is resolved at every rotation.

Further, there are provided a reel stop signal circuit 45 and a pay completion signal generating circuit 46 as the above-described input signal generating means. The reel stop signal circuit 45 generates signals for stopping the reels 3, 4 and 5 when the stop buttons 16, 17 and 18 are pushed. Further, a coin detect unit 47 counts a number of coins paid out from the hopper 38 and the pay completion signal generating circuit 46 outputs a signal informing completion of pay out of coins to CPU 31 when a counted value of actually paid-out coins, which is inputted from the coin detect unit 47 reaches data of a predetermined number of prize.

ROM 32 is stored with a procedure of a game process executed in the slot machine 1 as a sequence program as well as a prize probability table, a symbol table, a prize symbol combination table, and so on which are respectively classified from each other.

The prize probability table constitutes random number classifying means for classifying random numbers sampled by the sampling circuit 37 into respective prize modes and stores data for classifying random numbers in constant ranges generated by the random number generator 36 to respective prize modes. Such a prize probability table is constituted as shown by, for example, FIG. 7. Notations a1, a2 and a3, b1, b2 and b3, c1, c2 and c3, d1, d2 and d3, e1, e2 and e3, f1, f2 and f3, g1, g2 and g3 in FIG. 7, designate previously set numerical value data which are used in classifying random numbers sampled by the sampling circuit 37 into respective prize modes. According to the data, there are used combinations of respective numerical values of "a1, b1, c1, d1, e1, f1 and g1" when a number of sheets of inputted coins is one, "a2, b2, c2, d2, e2, f2 and g2" when it is two and "a3, b3, c3, d3, e3, f3 and g3" when it is three.

These numerical values are set under a large or small relationship of "a<b<c<d<e<f<g" and when a sampled random number value is less than a, a big hit prize (big hit) is constituted and a "BB" hit flag is erected. Further, when a sampled random number value is equal to or more than a and less than b, a medium hit prize (medium hit) is constituted and a "RB" hit flag is erected. Further, when a sampled random number value is equal to or more than b and less than f, a small hit prize (small hit) is constituted and in this case, when it is equal to or more than b and less than c, a "watermelon" hit flag is erected, when it is equal to or more than c and less than d, a "bell" hit flag is erected, when it is equal to or more than d and less than e, a "4 cherry" hit flag is erected and when it is equal to or more than e and less than f, a "2 cherry" hit flag is erected. Further, when a sampled random number value is equal to or more than f and less than g, a "replay" hit flag is erected and when it is equal to or more than g, a "blank" hit flag with no prize is erected.

That is, a prize mode is determined by the numerical value range to which a sampled random number value pertains and is represented by a total of 8 kinds of hit flags including "blank" and "replay". In this case, the random number generator 36, the sampling circuit 37, the prize probability table and the micon 30 constitute prize mode determining means. Various hits are caused under probabilities in accordance with data setting in such a prize probability table and therefore, they are not controlled completely by the skill of the player and a total coin pay rate in, for example, business hours of one day is maintained substantially constant.

Further, FIG. 8 conceptually shows the symbol table. The symbol table corresponds the rotational positions of the respective reels 3 through 5 with symbols and represents columns of symbols by notations. The symbol table is stored with symbol codes in correspondence with code numbers for the respective reels 3 through 5. The code numbers are successively provided at constant rotational pitches of the respective reels 3 through 5 with the rotational position for generating the reset pulse mentioned above as a reference. The symbol codes designate symbols provided in correspondence with the respective code numbers.

Further, the prize symbol combination table is stored with symbol codes of respective prize symbol combinations displayed on the prize display portion 22, symbol codes of symbol combinations constituting the "reach spot" indicating to the player that flags for causing a specific game are established, prize determination codes representing respective prizes, a number of sheets of coins for prize and so on. The prize symbol combination table is referred when the first reel 3, the second reel 4 and the third reel 5 are controlled to stop and when prize is confirmed after stopping all of the reels.

Next, an explanation will be given of the operation of the game machine controlled by the micon 30 according to the embodiment.

Figure 9:
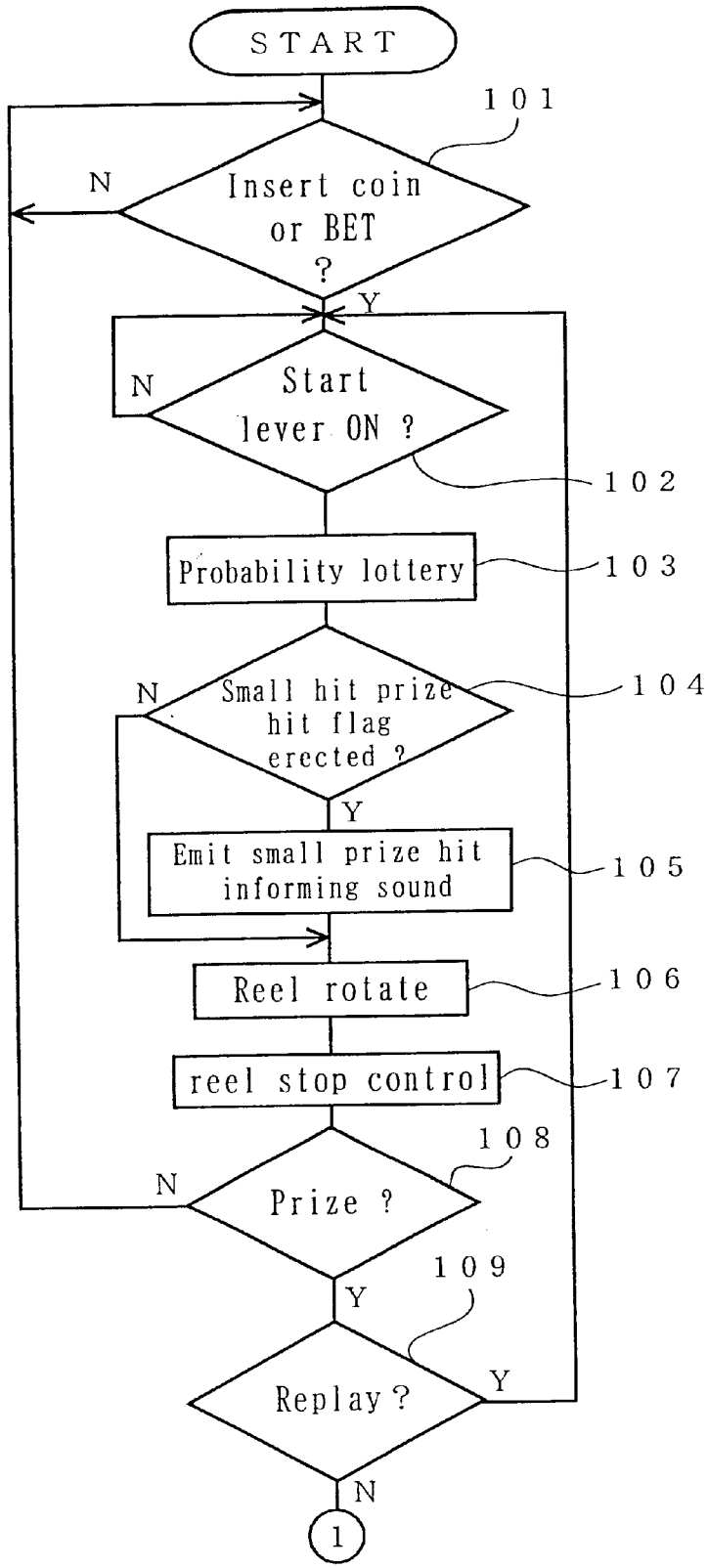
FIG. 9 is a first flowchart showing a game process of the slot machine according to the first embodiment of the present invention.
Figure 10:
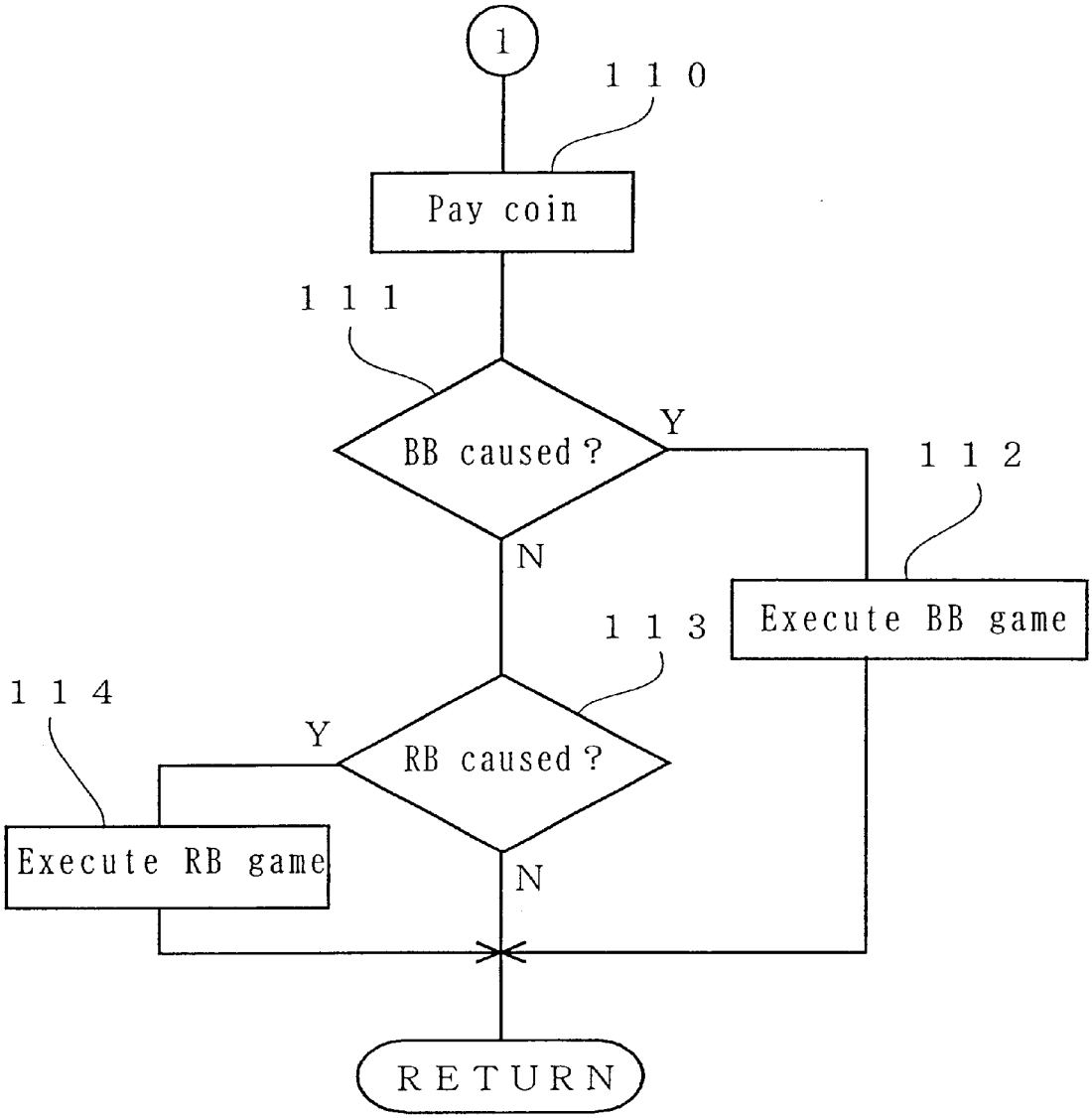
FIG. 10 is a second flowchart showing a game process of the slot machine according to the first, the second and the third respective embodiments of the present invention.

FIG. 9 and FIG. 10 are flowcharts showing an outline of the game process.

First, whether a coin BET is carried out is determined by CPU 31 (refer to step 101 of FIG. 9). The determination is "YES" when a coin is inserted into the coin slot 9 and a detection signal from the coin sensor 9S is inputted or signals from the BET switches 10, 11 and 12 are inputted. In this case, whether a start signal from the start switch 15S is inputted by operating the start lever 15 is determined (step 102).

When the determination is "YES", the determination of prize (probability lottery processing) is carried out by the prize mode determining means mentioned above (step 103). Timing of carrying out prize determination is shown by a timing chart of FIG. 11E and is carried out when operating the start lever 15 shown by FIG. 11D. As mentioned above, the prize determination is carried out by determining to which prize group a random number value generated at the random number generator 36 and specified by the sampling circuit 37, pertains in the prize probability table.

The prize mode determined by prize mode determining means is represented by a kind of a hit flag. There are 8 kinds of "blank", "2 cherry", "4 cherry", "bell", "watermelon", "replay", "RB" and "BB" as kinds of hit flag. Among these hit flags, respective flags of "2 cherry", "4 cherry", "bell" and "watermelon" are erected when a small hit prize is hit as a result of the inner lottery. Further, "RB" flag is erected when a medium hit prize is hit as a result of the inner lottery and "BB" flag is erected when a big hit prize is hit as a result of the inner lottery.

The hit flag of the small hit prize is effective only in the current game and cannot be carried over to the next game which is carried out by inserting a new coin. That is, the small hit prize mode is finished with a game where the small hit flag is set by the prize mode determining means. In contrast thereto, the RB hit flag and the BB hit flag can be carried over to several games. That is, according to bonus prize mode such as medium hit prize or big hit prize, when the RB hit flag or the BB hit flag is once set by the prize mode determining means, normally, the game state (RB is being hit inside the machine or BB is being hit inside thereof) continues until RB prize or BB prize is caused. Further, when RB prize is caused, the game state is brought into a state of operating RB and RB game, mentioned later, is carried out and when BB prize is caused, the game state is brought into a state of operating BB and BB game, mentioned later, is carried out.

Next, whether a hit flag of a small hit prize is erected is determined as a result of determination of the prize (step 104). When the hit flag of the small hit prize is erected, successively, a process of emitting sound announcing the small hit (step 105) is carried out. Further, when the hit flag of the small hit prize is not erected, the processing shift to step 106, mentioned later. According to the informing sound emitting processing at step 105, the speaker drive circuit 43 is controlled by CPU 31 and informing sound A, B, C or D in accordance with the kind of the hit flag of the small hit prize is emitted from the speaker 39.

Figure 11:
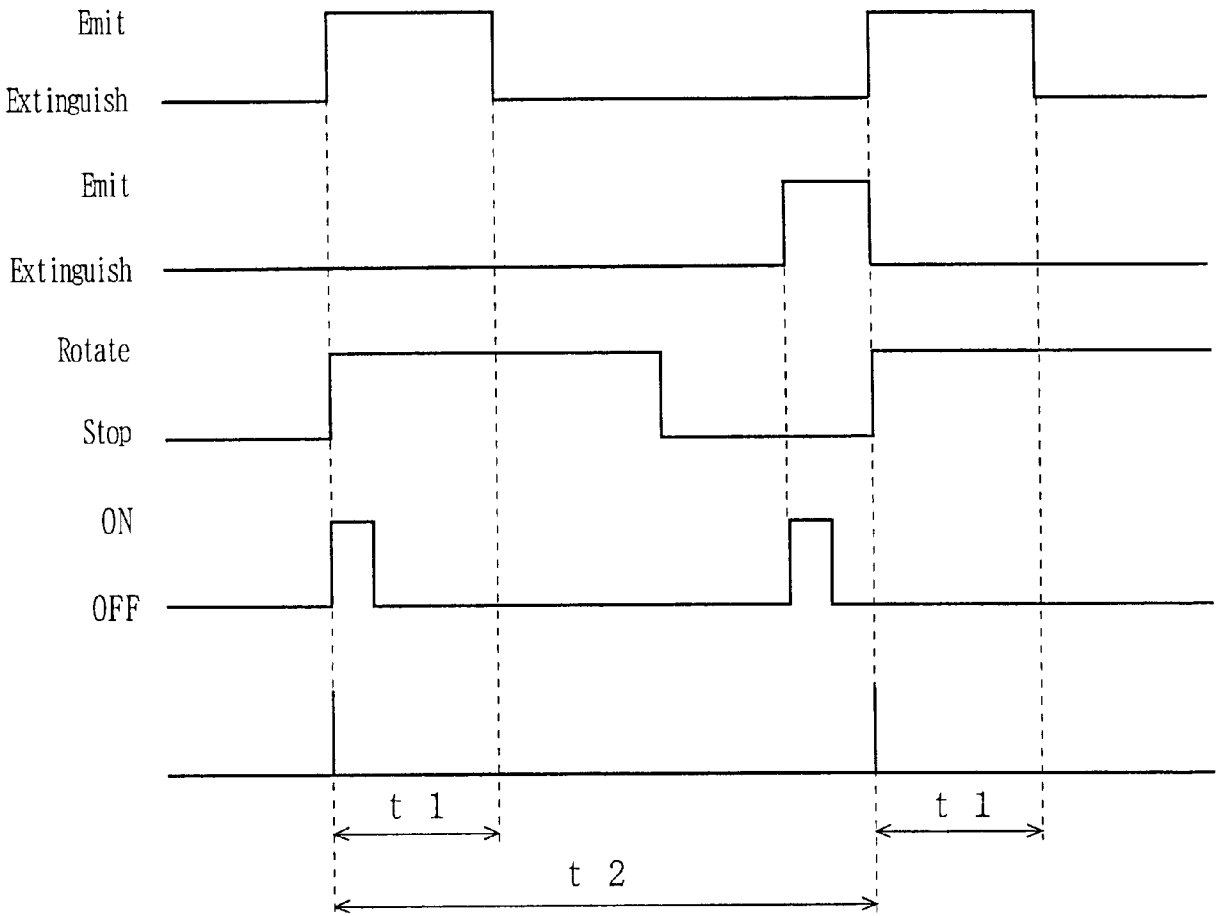
FIGS. 11A, 11B, 11C, 11D and 11E are timing chart diagrams showing timings of emitting informing sound in a game process of the slot machine according to the first embodiment of the invention.

That is, informing sound A is emitted from the speaker 39 when the hit flag of the small hit prize is "2 cherry" and informing sound B, C and D are respectively emitted from the speaker 39 in the cases of "4 cherry", "bell" and "watermelon". These informing sounds are transmitted to the player via the sound emitting hole 19 on the lower side of the front face of the machine. In this case, the speaker drive circuit 43, the speaker 39 and the micon 30 constitute informing means for announcing the small hit prize. Timings of emitting the small hit prize informing sound A, B, C and D are shown by FIG. 11A and the sound is emitted during a time period of t1 immediately after the lottery timing shown by FIG. 11E.

Next, a processing of rotating the reels 3, 4 and 5 is carried out (step 106), successively, a control of stopping the reels 3, 4 and 5 is carried out (step 107). The reel stopping control is carried out in accordance with a kind of a hit flag which is set as a result of prize determination. That is, when the hit flag is "blank", the motor drive circuit 40 is controlled by CPU 31 and the respective reels 3 through 5 are controlled to stop such that a prize symbol combination is not aligned in any of the effective prize lines.

Further, when a hit flag is "2 cherry", the motor drive circuit 40 is controlled by CPU 31 and the respectives reels 3 through 5 are controlled to stop such that a combination of symbols "cherry" is aligned in any of the effective prize lines. Further, when a hit flag is "4 cherry", the respective reels 3 through 5 are controlled to stop such that respective combinations of symbols "cherry" are aligned on two of the effective prize lines. Further, when a hit flag is "bell" or "watermelon" the respective reels 3 through 5 are controlled to stop such that a combination of symbols "bell" or "watermelon" is aligned on any of the effective prize lines.

Further, when a hit flag is "RB" or "BB", the respective reels 3 through 5 are controlled to stop such that a combination of symbols "7" or predetermined character symbols is aligned on any of the effective prize lines.

However, the stopping control is not totally carried out by the machine but is dependent on operational timings of the respective stop buttons 16 through 18 by the player. That is, even when the prize hit flag is erected as a result of the inner lottery, when the stop buttons 16 through 18 are not operated at predetermined timings by the player, a prize combination of symbols is not aligned on an effective prize line and the prize is not hit.

Therefore, next, whether display when the reels are stopped constitutes a predetermined prize combination of symbols is determined in reference to the prize symbol combination table (step 108). When the prize is not obtained, the determination is "NO" and the processing returns to initial step 101. In the case of replay game (replay) as a result of the prize determination, processings return to a processing of awaiting for operating the start lever 15 at step 102 (step 109). In the case of a prize which is not replay game, the hopper drive circuit 41 is controlled by CPU 31 and a predetermined number of coins are paid out to the coin tray 20 by the hopper 38 (FIG. 10, step 110).

For example, in the case of a small hit prize of "2 cherry", 2 coins are paid out and in the case of a small hit prize of "4 cherry", 4 coins are paid out. Further, in the case of a small hit prize of "bell", 6 coins are paid out and in the case of a small hit prize of "watermelon", 8 coins are paid out. Further, in the case of a big hit prize of "BB" or "RB", 15 coins are paid out, respectively.

Next, whether BB game is caused is determined (step 111) and when BB game is caused, BB game is executed (step 112). According to the BB game, sets of general game and bonus game can be carried out by a plurality of times. In a general game of the BB game, a small hit prize is caused with high probability. Further, a bonus game is a game in which a plurality of times of high prize games constitute one set. Even in a general game of the BB game, when a hit flag of a small hit prize is erected by the inner lottery, informing sound in accordance with the prize mode is emitted from the speaker 39, as mentioned above.

When BB game is not caused, next, whether RB game is caused is determined (step 113) and when RB game is caused, RB game is executed (step 114). According to the RB game, the above-described bonus game can be executed once. Therefore, although according to a small hit prize, a small number of coins can be obtained as mentioned above, in RB game or BB game, a large number of games can be carried out and accordingly, normally, a large number of coins can be acquired.

Thereafter, the above-described processings are repeated and the slot machine game is carried out. At this occasion, the start lever 15 needs to operate at an interval of a time period t2, for example, 4.1 seconds. For example, when successive lever operations are carried out within a time period t2 from start lever operation at a preceding time as shown by FIG. 11D, reel rotation inhibit sound emitted from the speaker 39 at a timing shown by FIG. 11B. In this case, FIG. 11C shows a rotational state of a reel which has stopped in a preceding game, and the reel starts rotating after a time period t2 since the start of the rotational operation of the preceding game. In such a case, as shown by FIG. 11A, the small hit prize informing sound of successive game is also emitted after time period t2.

According to such an embodiment, the player can know in advance that a small hit prize is caused by the inner lottery before operating the respective stop buttons 16 through 18 by hearing informing sound A, B, C or D emitted from the speaker 39. Therefore, operation of the stop buttons 16 through 18 can be carried out by aiming at stopping and displaying a small hit prize symbol displayed at the prize display portion 22. When the small hit prize is not informed, the player does not know which symbol is to be stopped and displayed at the respective reels 3 through 5, however, according to the embodiment, the kind of the pattern to be stopped and displayed can be narrowed down and the stop button operation is facilitated.

Further, according to the embodiment, the small hit prize informing means is constituted such that a plurality of kinds of sound A, B, C and D in one-to-one correspondence with the modes of the small hit prizes are emitted and the kind of the small hit prize is also informed to the player. Therefore, which small hit prize in the small hit prizes is hit can be known in advance and operation of the stop buttons 16 through 18 can be carried out by aiming at stopping and displaying only the prize symbol from the start. Therefore, the stop button operation can be carried out easily.

Further, when the small hit prize flag is erected, informing sound A, B, C and D are emitted and accordingly, the player can also enjoy the sound. For example, by constituting the respective informing sound by animal cry such as elephant cry "pao" for the informing sound A or tiger cry such as "gao" for the informing sound B, interest in the informing sound is enhanced and enjoyment of slot machine game is promoted.

Further, although according to the above-described embodiment, the informing sound of hitting the inner lottery is constituted such that a plurality of kinds of informing sounds are emitted in one-to-one correspondence with the respective kinds of the small hit prizes, the one-to-one correspondence is not necessarily needed. For example, when the informing sound is constituted by 2 kinds of A and B and when the small hit prize is determined by the prize mode determining means, informing sound A may be emitted from the speaker 39 and when a big hit prize is determined, the informing sound B may be emitted from the speaker 39. In this case, it can be known that the hit flag of the small hit prize is erected by a difference between the informing sound A and B. However, the kind of the small hit prize cannot be known.

Also according to the invention, it can previously be known that the hit flag of the small hit prize is erected by the inner lottery and the kinds of symbols to be stopped and displayed at the respective reels 3 through 5 can be narrowed down. Therefore, the stop button operation is facilitated, further, the informing sound can also be enjoyed.

Next, an explanation will be given of a second embodiment in which a game machine according to the invention is applied to a slot machine.

The constitution of the slot machine according to the embodiment differs from the constitution of the slot machine according to the first embodiment in the following respective points and the constitutions other than these are the same as those of the slot machine according to the above-described embodiment.

That is, according to the slot machine of the above-described embodiment, when a small hit prize is drawn by the probability lottery processing (FIG. 9, step 103), the small hit prize is necessarily announced to the player by the informing means. However, according to the slot machine of the embodiment, even when a small hit prize is drawn by the probability lottery processing, the small hit prize is not necessarily announced to the player. Further, even when a prize mode other than small hit prize is determined by the prize mode determining means, there is a case in which a small hit prize is previously informed. Further, although according to the above-described embodiment, the informing means is constituted by the speaker 39, according to the embodiment, the informing means is constituted by the respective back lamps 57*a*, 57*b* and 57*c* of the respective reels 3 through 5.

A detailed description will be given of the slot machine according to the embodiment as follows.

According to the slot machine of the embodiment, ROM 32 is stored with a prize mode informing selection lottery probability table. The prize mode informing selection lottery probability table is referred to when a prize mode determined by the prize mode determining means is informed to the player with predetermined probability.

The prize mode informing selection lottery probability table exemplified in FIG. 12 is shown in correspondence with the probability table of a 3 coin bet in the prize probability table shown by FIG. 7. That is, at upper columns of the informing selection lottery probability table, there are shown respective values of numerical value data a3, b3, c3, d3, e3, f3 and g3 which are hit section data in a 3 coin bet shown by FIG. 7. Further, at lower columns, respective values of inform section data in 3 coin bet general game are shown. In this case, the random number generator 36 generates random numbers in a range of 0 through 65535 ($=2^{16}$).

According to the table, when a random number in a range of 0 through 200 is sampled by the sampling circuit 37 in determining the prize, the inner lottery result constitutes a big hit prize, "BB" hit flag is erected. When a random number in a range of 201 through 380 is sampled by the sampling circuit 37, the inner lottery result constitutes a medium hit prize and "RB" hit flag is erected. Similarly, when a random number in a range of 381 through 10000 is sampled, a hit flag of a small hit prize of each kind is erected. When a random number in a range of 10001 through 18000 is sampled, "replay" hit flag is erected and when a random number in a range of 18001 through 65535 is sampled, "blank" hit flag is erected.

Further, when a random number in a range of 381 through 770 or 20381 through 20800 is sampled by the sampling circuit 37 in determining the prize, "watermelon" hit flag is previously informed. That is, when a random number in the range of 381 through 770 is sampled and "watermelon" hit flag is erected, a prize mode of the "watermelon" hit flag is previously informed. Further, even when a random number in a range of 20381 through 20800 is sampled and "blank" hit flag is erected, the prize mode of the "watermelon" hit flag is informed. In the meantime, when a random number in a range of 771 through 800 is sampled and "watermelon" hit flag is erected, the random number in the range is out of range of inform section data of "watermelon" hit flag and accordingly, the prize mode of the "watermelon" hit flag is not informed.

That is, even when prize mode of "watermelon" hit flag is informed, the "watermelon" hit flag is not necessarily erected by the inner lottery. Further, even when the prize mode of the "watermelon" hit flag is not informed, it is not necessarily established that the "watermelon" hit flag is not erected by the inner lottery. The prize mode of the "watermelon" hit flag is informed under predetermined reliability. In the case of the table shown by FIG. 12, the probability of informing the prize mode when the "watermelon" hit flag is erected, is 390/810 or about 48% {(390 of 381–770)/(a sum of 390 of 381–770 and 420 of 20381–20800)}. Further, the probability of informing the prize mode when the "watermelon" hit flag is not erected is 420/810 or about 53%. As a result, the operation of informing the prize mode is missed by the probability of about 52%.

Such an operation of informing the prize mode is similarly carried out in respect of other respective hit flag of other than a small hit prize, a hit flag of "BB" or "RB" of a big hit or a medium hit prize or a hit flag of "replay". However, the reliability of informing the prize mode need not necessarily be uniform in all prizes but may differ depending on a number of inserted coins or a game state. For example, according to the table shown by FIG. 12, the probability of hitting information of a "bell" hit flag is 1000/1100 or about 91% and the probability of missing the information is 100/1100 or about 9%.

Next, an explanation will be given of the game process according to the embodiment in reference to a flowchart shown by FIG. 13 and timing charts shown by FIGS. 14A, 14B, 14C, 14D, 14E, 14F, 14G, 14H, 14I and 14J.

Steps 121 through 123 of the flowchart are the same as steps 101 through 103 of the flowchart shown by FIG. 9 according to the first embodiment and firstly, presence or absence of coin BET is determined by CPU 31 (step 121). When coin BET is present, successively, whether the start lever 15 is operated is determined (step 122) and when the start lever 15 is operated, the prize mode is determined by the above-described probability lottery processing (step 123). Next, processing of rotating the reels 3, 4 and 5 is carried out (step 124).

When the start lever 15 is operated at a timing shown by FIG. 14H, as shown by FIG. 14A, FIG. 14B and FIG. 14C, the respective reels 3 through 5 simultaneously start rotating in accordance with operation of the start lever 15. The probability lottery processing at step 123 is carried out at a timing shown by FIG. 14I and is carried out in operating the start lever 15.

Next, successive to the probability lottery processing, there is carried out informing selection lottery processing of the prize mode (step 125). The informing selection lottery timing is carried out at a timing shown by FIG. 14J and is carried out immediately after operating the start lever 15. As mentioned above, the informing selection lottery processing of the prize mode is carried out by the informing selection lottery probability table exemplified in FIG. 12 and is carried out by determining to which section of the inform section data of the probability table a random number value specified by the sampling circuit 37 in determining the prize pertains. A result of the informing selection lottery is also written to a predetermined region of RAM 33 and in the case the prize mode is previously informed, an informing flag is set at step 125. The set informing flag also represents a kind of the prize mode to be informed.

Next, it is determined whether a small hit prize informing flag is erected by the informing selection lottery processing, that is, whether the sampled random number value is a value pertaining to inform section data of a small hit prize is determined (step 126). When the sampled random number value pertains to the inform section data of the small hit prize and the small hit prize informing flag is erected, successively, a processing of controlling to light the reel lamp (step 127) is carried out. Further, when the small hit informing flag is not erected, processings are shifted to step 128.

Although according to the above-described first embodiment, a flag which is referred to in previously informing a small hit prize is a hit flag of the small hit prize, according to the embodiment, a small hit prize informing flag is referred to in previously informing the small hit prize. Therefore, as described above, the small hit prize is announced under predetermined reliability and the information may be hit or may be missed. Further, even when a blank hit prize mode is determined by the prize mode determining means, there is a case in which a small hit prize is known in advance.

According to a reel lamp lighting control processing at step 127, the lamp drive circuit 48 is controlled by CPU 31 and the respective back lamps 57*a*, 57*b* and 57*c* of the first reel 3 are controlled to light in accordance with the kind of the small hit prize informing flag. In this case, the lamp drive circuit 48, the respective back lamps 57*a*, 57*b* and 57*c* and the micon 30 constitute informing means for announcing a small hit prize. Further, the respective back lamps 57*a*, 57*b* and 57*c* built in the respective reels 3 through 5 are simultaneously lighted when inserting coins.

Figure 15A:
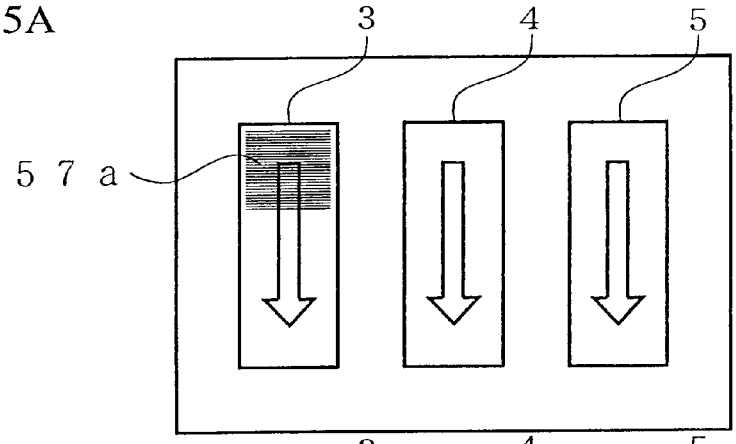
FIGS. 15A, 15B, 15C and 15D are views showing display modes of reel back lamps controlled to light by informing means in a game process of the slot machine according to the second embodiment of the present invention.
Figure 15B:
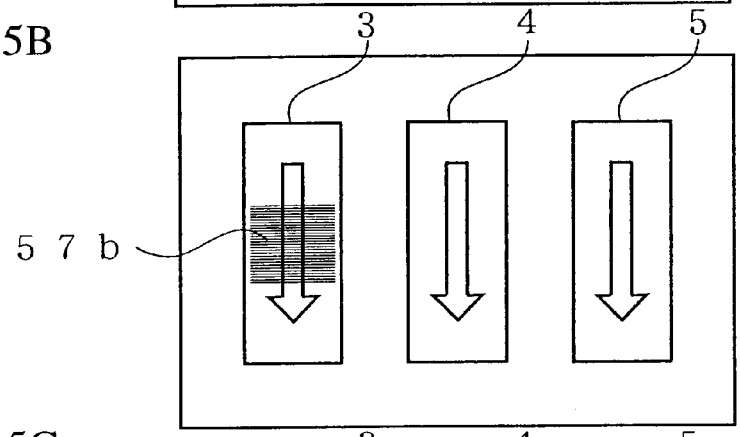
Figure 15C:
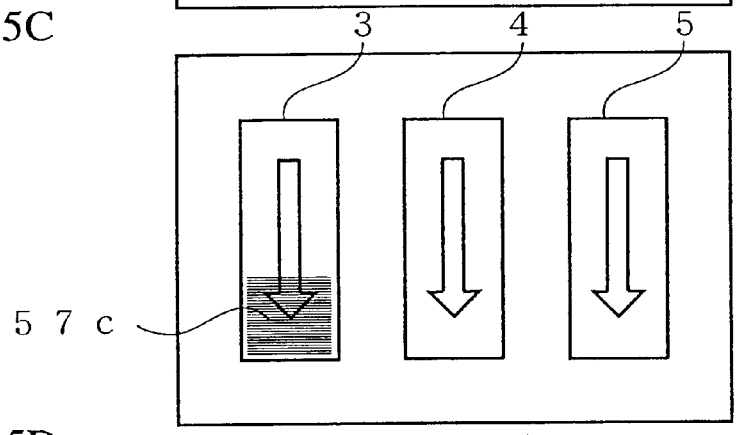
Figure 15D:
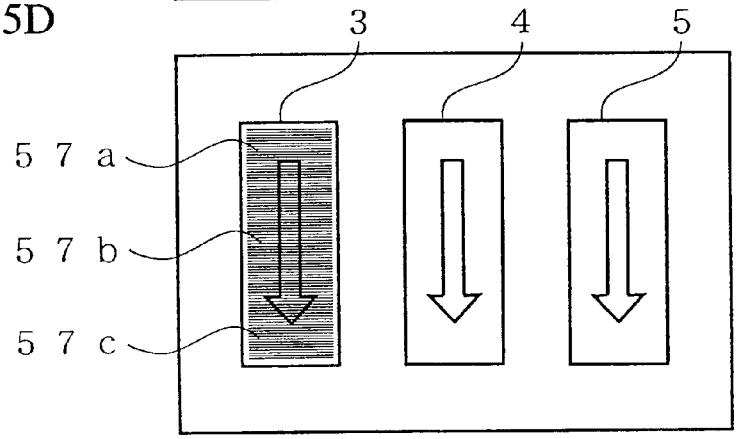

For example, when a flag to announce a small hit prize of "2 cherry" is set, at a timing shown by FIG. 14G in correspondence with the informing selection lottery timing shown by FIG. 14J, only the back lamp 57*a* at the upper stage of the first reel 3 is extinguished as shown by FIG. 15A. At this occasion, the first reel 3 as well as the second reel 4 and the third reel 5 continue rotating. Further, when a flag to announce a small hit prize of "4 cherry" is set, at a similar timing in accordance with the informing selection lottery timing, only the back lamp 57*b* at the middle stage of the first reel 3 is extinguished as shown by FIG. 15B. Further, when a flag announcing a small hit prize of "bell" is set, at a timing in correspondence with the informing selection lottery timing, only the back lamp 57*c* at the lower stage of the first reel 3 is extinguished as shown by FIG. 15C. Further, when a flag announcing a small hit prize of "watermelon" is set, at a timing in correspondence with the informing selection lottery timing, all of the back lamps 57*a*, 57*b* and 57*c* of the first reel 3 are extinguished as shown by FIG. 15D.

Thereafter, the reels 3, 4 and 5 are controlled to stop (step 128). The reels are stopped at timings shown by, for example, FIG. 14D, FIG. 14E and FIG. 14F and are stopped after operating respective buttons of the first reel stop button 16, the second reel stop button 17 and the third reel stop button 18. Further, in this case, for convenience of explanation, the explanation has been given of a case in which the first reel stop button 16, the second reel stop button 17 and the third reel stop button 18 are operated in this order and the respective reels 3 through 5 are stopped in the order of the first reel 3, the second reel 4 and the third reel 5. However, the order of stopping the respective r eels 3 through 5 is not limited thereto but, for example, the reels may be stopped by a random operation order as in, for example, the first reel stop button 16, the third reel stop button 18 and the second reel stop button 17.

Next, whether the display in stopping the reels constitutes a predetermined prize combination of symbols is determined by referring to the prize symbol combination table (step 129). When the prize is not obtained, the processing returns to the initial step 121 and in the case of a replay game as a result of prize determination, the processing returns to a processing of awaiting for operating the start lever 15 at the step 122 (step 130).

Processing thereafter is carried out similarly in accordance with steps 110 through 114 of the flowchart shown by FIG. 10 explained in the first embodiment.

According to the embodiment, the player can know that a small hit prize is announced in advance by optically recognizing that the back lamps 57*a*, 57*b* and 57*c* of the first reel 3 are extinguished among the back lamps 57*a*, 57*b* and 57*c* of the respective reels 3 through 5 which are normally lighted in operating the start lever 15. Therefore, the small hit prize is announced before operating the respective stop buttons 16 through 18 and accordingly, the operation of the stop buttons 16 through 18 can be carried out by aiming to stop and display the small hit prize patterns indicated at the prize display portion 22.

Further, according to the invention, the informing means is constituted to also announce the kind of the small hit prize to the player by controlling to light the respective back lamps 57*a*, 57*b* and 57*c* of the first reel 3 by four modes in one-to-one correspondence with the modes of the small hit prizes. Accordingly, the player can know in advance which small hit prize in small hit prizes is provided with high probability of hit and the operation of the stop buttons 16 through 18 can be carried out by aiming at stopping and displaying only the prize symbols from the start. Further, the respective back lamps 57*a*, 57*b* and 57*c* are lighted in various modes and accordingly, the player can also enjoy the display modes.

Further, the small hit prize mode is announced not in respect of all of the result of the inner lottery but with the predetermined probability as indicated in the informing selection lottery probability table (refer to FIG. 12). Further, there is a case in which a prize mode different from a prize mode determined by the prize mode determining means is announced with a predetermined probability. Therefore, the small hit prize mode is announced to the player or may not be announced thereto. Therefore, information of the small hit prize mode is expected by the player and when the information is carried out, the pleasure is enhanced and enjoyment of game is promoted.

Further, although according tot he above-described explanation of the embodiment, the respective back lamps 57*a*, 57*b* and 57*c* of the first reel 3 are constituted to announce the kind of the small hit prize mode by controlling their lighting individually, there may be constructed a constitution in which the respective back lamps 57*a*, 57*b* and 57*c* are controlled to simultaneously light for each of the respective reels 3 through 5 and the kind of the small hit prize mode to be announced. For example, when the small hit prize of "2 cherry" is announced, three of the respective back lamps 57*a*, 57*b* and 57*c* of the first reel 3 are simultaneously extinguished and when the small hit prize of "4 cherry" is announced, three of the respective back lamps 57*a*, 57*b* and 57*c* of the second reel 4 are simultaneously extinguished. Further, when the small hit prize of "bell" is announced, three of the back lamps 57*a*, 57*b* and 57*c* of the third reel 5 are simultaneously extinguished and when the small hit prize of "watermelon" is announced, all the back lamps 57*a*, 57*b* and 57*c* of the respective reels 3 through 5 are simultaneously extinguished.

Further, although in explaining the above-described embodiment, an explanation has been given of a constitution in which the informing means announces the small hit prize mode even when the "blank" prize mode is determined by the prize mode determining means, there may be constructed a constitution in which when a prize mode other than the small hit prize is determined, the small hit prize mode is not announced but the small hit prize mode is announced with predetermined probability only when the small hit prize mode is determined.

Further, although according to the above-described first embodiment, an explanation has been given of the constitution in which the small hit prize mode and its kind are announced by a plurality of sounds emitted from the speaker 39, similar to the above-described second embodiment, there can be constructed a constitution in which these are announced by controlling the lighting of the respective back lamps 57*a*, 57*b* and 57*c* in a plurality of modes. Further, although according to the above-described first embodiment, an explanation has been given of the constitution in which when the hit flag of the small hit prize is erected, the advance announcement is necessarily carried out by the plurality of sounds, there may be constructed a constitution in which the informing selection lottery probability table (refer to FIG. 12) explained in the second embodiment is used and the small hit prize is announced with predetermined probability.

Next, an explanation will be given of a third embodiment in which a game machine according to the invention is applied to a slot machine.

The constitution of the slot machine according to the embodiment differs from the constitution of the slot machine according to the above-described second embodiment in the following respective points. Other features of the machine are the same as those in the slot machine according to the above-described second embodiment. That is, the slot machine according to the third embodiment differs from the slot machine of the second embodiment in respective contents of the informing selection lottery processing (FIG. 13, step 125) and the reel lamp lighting control processing (step 127). In accordance therewith, the table stored in ROM 32 of the control circuit also differs.

According to the slot machine of the second embodiment, the informing selection lottery processing is carried out by selecting a prize mode to be announced in reference to the informing selection probability lottery table (refer to FIG. 12) and previous informing is carried out by selecting announcement information in accordance with the prize mode. However, according to the informing selection lottery processing of the slot machine of the third embodiment, as described later, a demonstration lottery table selecting table is referred to and the demonstration lottery table is selected in accordance with game state and prize mode. Further, the selected demonstration lottery table is referred to and the announcement information is selected in accordance with a lottery random number to thereby carry out the announcement.

Further, according to the slot machine of the second embodiment, the reel lamp lighting control processing is carried out by individually controlling the lighting of the respective back lamps 57*a*, 57*b* and 57*c* of the first reel 3. However, according to the slot machine of the third embodiment, as described later, the respective back lamps 57*a*, 57*b* and 57*c* are controlled to simultaneously light for each of the respective reels 3 through 5.

A detailed description will be given of the slot machine according to the third embodiment as follows.

According to the slot machine of the embodiment, a demonstration lottery table selecting table shown by FIG. 16 and demonstration lottery tables shown by FIG. 17 through FIG. 19 are stored in ROM 32. The demonstration lottery table selecting table and the demonstration lottery tables constitute informing mode selecting means for selecting a kind of an extinguishing pattern of reel back lamps which the informing means controls to light in accordance with the prize mode determined by the prize mode determining means.

The demonstration lottery table selecting table is for selecting demonstration lottery tables of No. 0 through No. 17 based on a game state and a hit flag. The game state becomes clear by referring to a game level status (GMLVSTS) storing region shown by FIG. 20A, the GMLVSTS storing region is stored as data of 1 byte in RAM 33. Bits 0 through 4 are stored with game states and game state in which data is turned ON by being set to 1 is the game state at that time. There are five kinds of game states, namely, "RB operation", "BB operation", "general game", "in inner hit of RB" and "in inner hit of BB".

A hit flag becomes clear by referring to a flag counter (FLGCTR) storing region shown by FIG. 20B. The FLGCTR storing region is stored also as data of 1 byte in RAM 33. A hit flag at that time is indicated by 1 byte data of 00 through 07 of 16-adic.

For example, when data of bit 2 of GMLVSTS is set to 1 (04H) and data of FLGCTR is 02H, the game state is a general game and the hit flag is 4 cherry. Therefore, the demonstration lottery table at that time is a demonstration lottery table of No. 2 from demonstration lottery table selecting table. The No. 2 demonstration lottery table is shown by FIG. 17 and the kind of a reel lamp extinguishing pattern is selected by lottery, mentioned later, using the lottery values indicated in the table. For example, when a combination of a row of a lottery value 49 is selected in the demonstration lottery table of No. 2, the reel lamp extinguishing pattern becomes pattern 2.

Further, in the case in which the game state status is general game and the flag counter is 4 cherry, as mentioned above, when a combination of a row of lottery value 30 at the lowest column of the No. 2 demonstration lottery table is selected, the reel lamp extinguishing pattern becomes pattern 3. Further, when data of bit 2 of GMLVSTS is set to 1 and data of FLGCTR is 04H, the game state is general game and the hit flag is watermelon. The demonstration lottery table at this occasion is a demonstration lottery table of No. 4 from the demonstration lottery table selecting table.

The No. 4 demonstration lottery table is shown by FIG. 17 and when a row of lottery value 14 is selected from the table by lottery, according to a representation mode combination at this occasion, the reel lamp extinguishing pattern becomes pattern 3. That is, even in the game establishing a different hit flag, depending on a value of a random number for determining a previously informing pattern, there is a possibility in which the same previously informing pattern emerges.

In this way, although the kind of hit flag is announced to the player by the kind of a reel lamp extinguishing pattern determined in accordance with the game state at that occasion, the reliability is not uniform. For example, even when a hit flag of 4 cherry in a general game is informed previously as described above, the 4 cherry flag is not necessarily hit at that occasion. That is, the probability of informing the player when a 4 cherry flag is hit in a general game is X (=0 through 100) % and the probability for informing the player even when the 4 cherry flag is not hit in a general game is (100–X) %.

Further, similar to the second embodiment, in this third embodiment, the lamp drive circuit 48, the back lamps 57*a*, 57*b* and 57*c* and the micon 30 constitute informing means for displaying the respective reels 3 through 5 and announcing a prize mode to the player with predetermined probability. There are five kinds of display modes represented by the informing means.

The first display mode is a display mode of "no reel lamp extinguishing pattern" and the informing means brings the respective back lamps 57*a*, 57*b* and 57*c* of the respective reels 3 through 5 into a state in which they remain lighted without being extinguished immediately after operating the start lever 15. The second display mode is a display mode of "reel lamp extinguishing patten 1" shown by FIG. 21A in which the respective back lamps 57*a*, 57*b* and 57*c* of the first reel 3 are extinguished immediately after operating the start lever 15. The third display mode is a display mode of "reel lamp extinguishing pattern 2" shown by FIG. 21B in which the respective back lamps 57*a*, 57*b* and 57*c* of the second reel 4 are extinguished immediately after operating the start lever 15. The fourth display mode is a display mode of "reel lamp extinguishing pattern 3" shown by FIG. 21C in which the respective back lamps 57*a*, 57*b* and 57*c* of the third reel 5 are extinguished immediately after operating the start lever 15. The fifth display mode is a display mode of "reel lamp extinguishing pattern 4" shown by FIG. 21D in which the respective back lamps 57*a*, 57*b* and 57*c* of all the reels 3 through 5 are extinguished immediately after operating the start lever 15.

Further, the respective back lamps 57*a*, 57*b* and 57*c* built in the respective reels 3 through 5 are simultaneously lighted when coins are inserted.

The display mode of "no reel lamp extinguishing pattern" emerges with high probability when the flag counter becomes "blank" in the demonstration lottery table selecting table and No. 17 demonstration lottery table is selected or when the flag counter becomes "replay" and No. 0 demonstration lottery table is selected. Further, the display mode of "reel lamp extinguishing pattern 1" corresponds to a small hit prize of "2 cherry" and emerges with high probability when the flag counter becomes "2 cherry" in the demonstration lottery table selecting table and the demonstration lottery tables No. 1, No. 5, No. 9 and No. 13 are selected. Further, the display mode of "reel lamp extinguishing pattern 2" corresponds to a small hit prize of "4 cherry" and emerges with high probability when the flag counter becomes "4 cherry" in the demonstration lottery table selecting table and the demonstration lottery tables No. 2, No. 6, No. 10 and No. 14 are selected.

Further, the display mode of "reel lamp extinguishing pattern 3" corresponds to a small hit prize of "bell" and emerges with high probability when the flag counter becomes "bell" in the demonstration lottery table selecting table and the demonstration lottery tables No. 3, No. 7, No. 11 and No. 15 are selected. The display mode of "reel lamp extinguishing pattern 4" corresponds to a small hit prize of "watermelon" and emerges with high probability when the flag counter becomes "watermelon" in the demonstration lottery table selecting table and the demonstration lottery tables No. 4, No. 8, No. 12 and No. 16 are selected.

Figure 13:
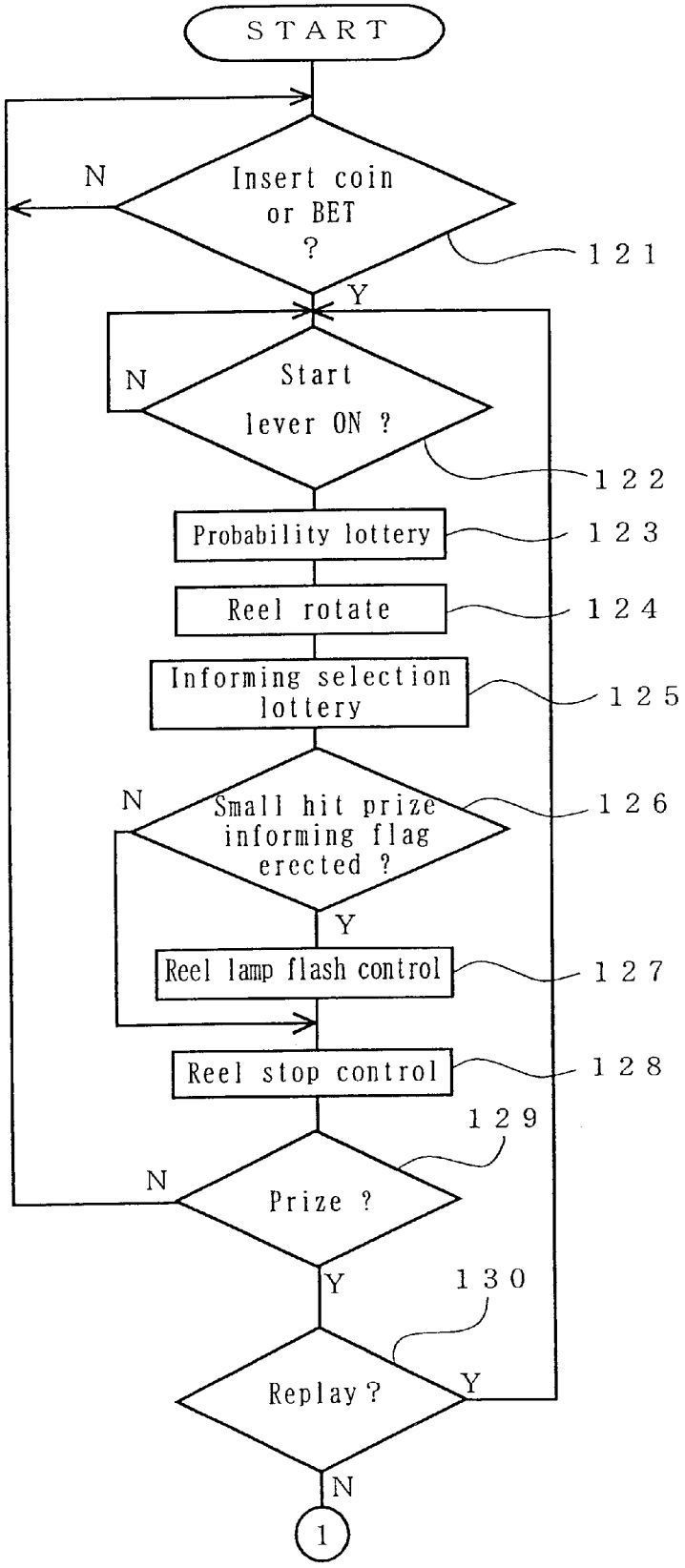
FIG. 13 is a first flowchart showing a game process of the slot machine according to the second and the third respective embodiments of the invention.

Also, the game process according to the embodiment is represented similar to the flowchart shown by FIG. 13 used in the above-described second embodiment and the flowchart shown by FIG. 10 successive thereto. Next, an explanation will be given of the game process according to the embodiment in reference to the flowcharts and the timing charts shown by FIGS. 14A, 14B, 14C, 14D, 14E, 14F, 14G, 14H, 14I and 14J.

Also in the embodiment, firstly, presence or absence of coin BET is determined by CPU 31 (FIG. 13, step 121). In the case of presence of coin BET, successively, whether the start lever 15 is operated is determined (step 122) and when the start lever 15 is operated, a prize mode is determined by the above-described probability lottery processing (step 123). Next, the processing of rotating the reels 3, 4 and 5 is carried out (step 124).

Next, the informing selection lottery processing of the prize mode is carried out (step 125). The informing selection lottery timing is carried out at the timing shown by FIG. 14J as mentioned above and is carried out immediately after operating the start lever 15. The informing selection lottery processing is carried out in accordance with a flowchart shown by FIG. 22.

Figure 22:
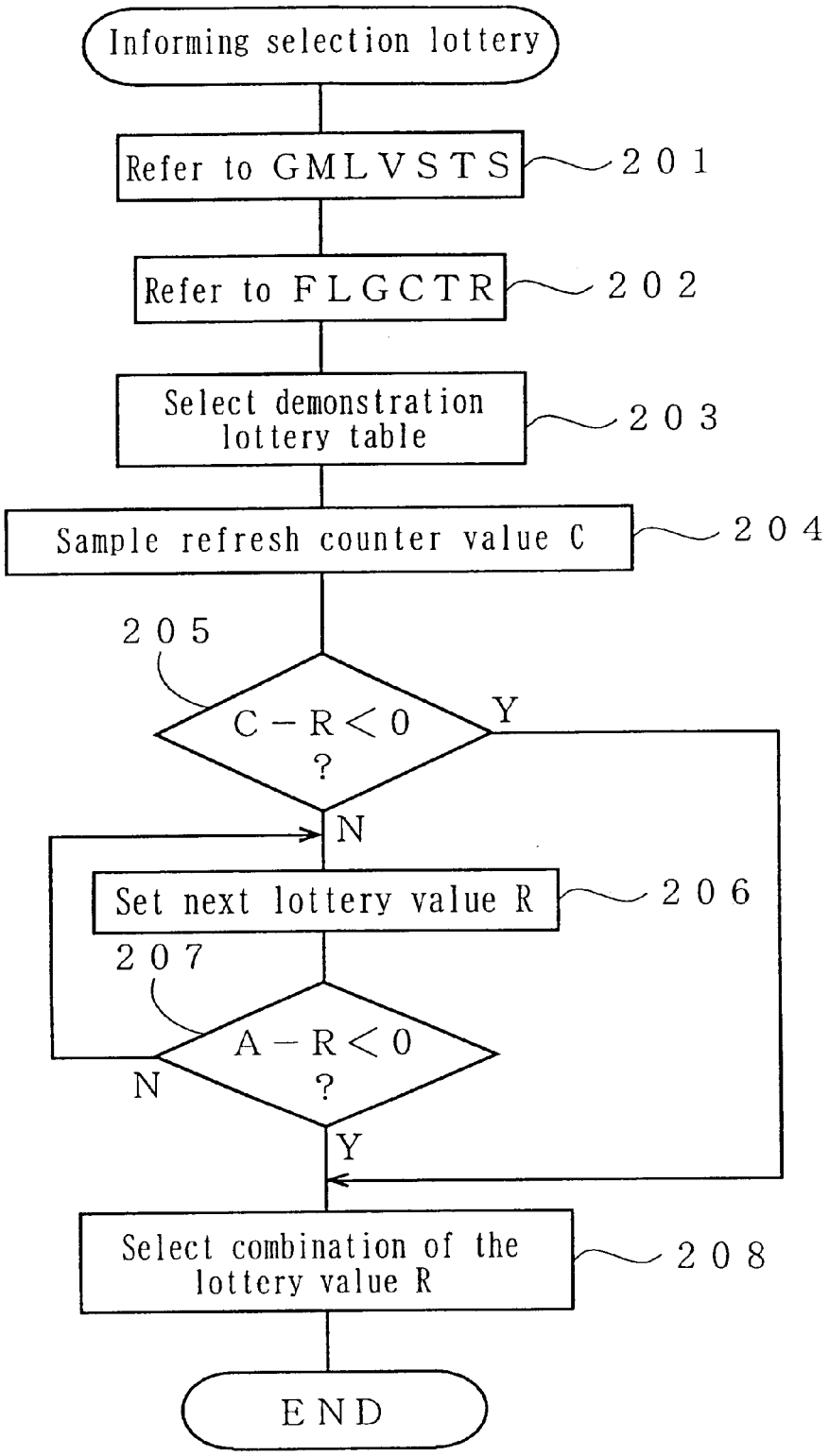
FIG. 22 is a flowchart showing a content of informing selection lottery processing according to the third embodiment of the invention.

First, the GMLVSTS region stored in RAM 33 (refer to FIG. 20A) is referred to and game state at that occasion is determined (FIG. 22, step 201). Next, data stored in the FLGCTR region is referred to and the kind of the hit flag is determined (202). Next, any one of No. 0 through No. 17 demonstration lottery tables is selected in reference to the demonstration lottery table selecting table (refer to FIG. 16) based on game state and the kind of the hit flag at that occasion (step 203). Next, a counter value C is sampled from a counter for refreshing RAM 33 at constant time intervals at an arbitrary timing (step 204).

The counter value C is varied in a range of 0 through 127 and the random number lottery is carried out for selecting the informing mode by using the sampled counter value C. That is, a lottery value R at the uppermost row of a demonstration lottery table selected at step 203 is subtracted from the counter value C and positiveness or negativeness of the result of subtraction A (=C–R) is determined (step 205). When the result of subtraction A does not become negative, successively, a lottery value at a next row of the table is set to the lottery value R (step 206), thereafter, a subtraction of A−R is carried out and positiveness or negativeness of the result A (=A−R) is determined (step 207). The calculation is carried out until the result of subtraction A becomes negative and when the result of subtraction A becomes negative, a reel lamp extinguishing pattern of the row of the lottery value R is selected to a representation mode which is to be previously informed (step 208).

For example, when a 4 cherry flag is hit in a general game, as mentioned above, there is selected the No. 2 demonstration lottery table as mentioned above and the selection lottery processing of display mode at this occasion is carried out as follows. First, when 15 is sampled as the refresh counter value C at step 204, in the subtraction of C—R at step 205, the lottery value R is first set with a lottery value 3 at the uppermost row and the result of subtraction becomes A=15−3=12. The result of subtraction A is positive and accordingly, successively, a lottery value 10 at the next row of the table is set to the lottery value R and positiveness or negativeness of the result of subtraction A=12−10=2 is determined. The result of subtraction A is also positive and therefore, successively, a lottery value 5 at the next row of the table is set to the lottery value R and positiveness or negativeness of the result of subtraction A=2−5=−3 is determined. The result of subtraction A is negative and accordingly, the reel lamp extinguishing pattern 1 at the row of the lottery value 5 is selected as the previously informing mode.

The result of the informing selection lottery is written to the predetermined region of RAM 33 and an informing flag is set at step 125. At this occasion, when "no reel lamp extinguishing pattern" is selected as the previously informing mode, no informing flag is set. Further, when "reel lamp extinguishing pattern 1" is selected as the previously informing mode, an informing flag of a small hit prize of "2 cherry" is set and when "reel lamp extinguishing pattern 2" is selected as the previously informing mode, an informing flag of a small hit prize of "4 cherry" is set. Further, when "reel lamp extinguishing pattern 3" is set as the previously informing mode, an informing flag of a small hit prize of "bell" is set and when "reel lamp extinguishing pattern 4" is selected as the previously informing mode, an informing flag of a small hit prize of "watermelon" is set.

Next, it is determined whether an informing flag of a small hit prize is erected by the informing selection lottery processing (FIG. 13, step 126). When the informing flag of a small hit prize is erected, successively, the reel lamp lighting control processing (step 127) is carried out. When the informing flag of a small hit prize is not erected, the processing is shifted to step 128.

According to the reel lamp lighting control processing at step 127, the lamp drive circuit 48 is controlled by CPU 31 and the respective back lamps 57*a*, 57*b* and 57*c* of the respective reels 3 through 5 are controlled to light in accordance with a kind of a hit informing flag.

Figure 21A:
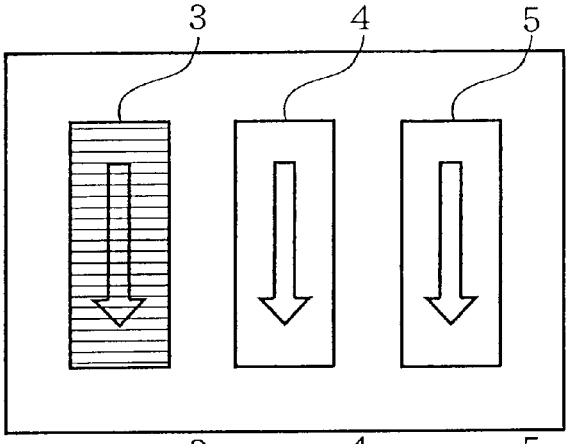
FIGS. 21A, 21B, 21C and 21D are views showing display modes of reel back lamps controlled to light by the informing means in a game process of the slot machine according to the third embodiment of the invention.
Figure 21B:
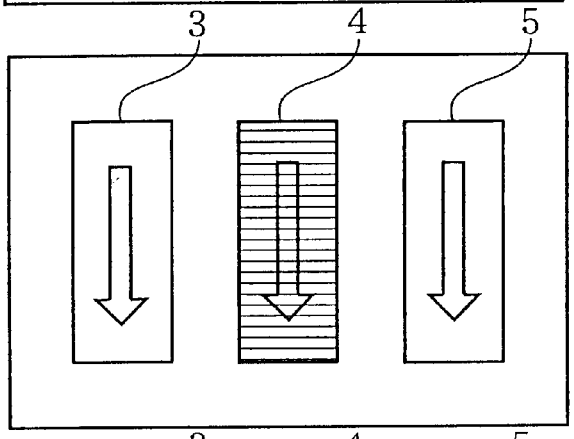

For example, when the previously informing flag is set as a small hit prize of "2 cherry" at the timing shown by FIG. 14G in correspondence with the informing selection lottery timing shown by FIG. 14J, the respective back lamps 57*a*, 57*b* and 57*c* of the first reel 3 are extinguished as shown by FIG. 21A. At this occasion, the first reel 3 as well as the second reel 4 and the third reel 5 continue rotating. As mentioned above, the display mode corresponds to "reel lamp extinguishing pattern 1" and emerges with high probability in the small hit of "2 cherry". Further, when the previously informing flag is set as the small hit prize of "4 cherry" at a similar timing in correspondence with the informing selection lottery timing, the respective back lamps 57*a*, 57*b* and 57*c* of the second reel 4 are extinguished as shown by FIG. 21B. The display mode corresponds to "reel lamp extinguishing pattern 2" and emerges with high probability in the small hit of "4 cherry".

Figure 21C:
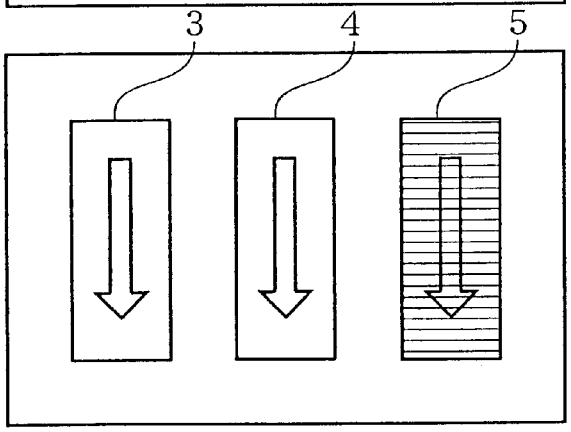
Figure 21D:
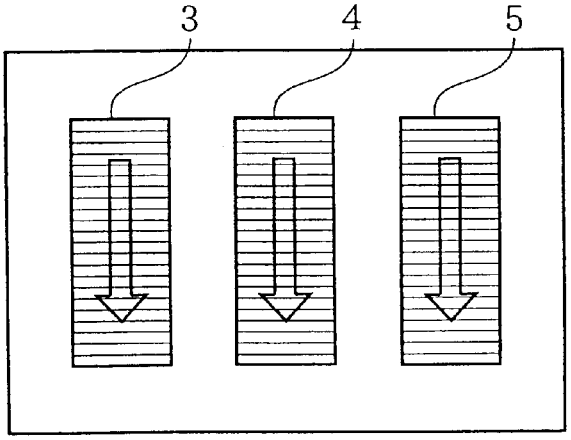

Further, when the previously informing flag is set as the small hit prize of "bell", at a similar timing in correspondence with the informing selection lottery timing, the respective back lamps 57*a*, 57*b* and 57*c* of the third reel 5 are extinguished as shown by FIG. 21C. The display mode corresponds to "reel lamp extinguishing pattern 3" and emerges with high probability in the small hit of "bell". Further, when the previously informing flag is set as the small hit prize of "watermelon" at a similar timing in correspondence with the informing selection lottery timing, the respective back lamps 57*a*, 57*b* and 57*c* of all the reels 3 through 5 are extinguished as shown by FIG. 21D. The display mode corresponds to "reel lamp extinguishing pattern 4" and emerges with high probability in the small hit of "watermelon".

Thereafter, the control of the reels 3, 4 and 5 is carried out (FIG. 13, step 128). The reels are stopped at timings shown by FIG. 14D, FIG. 14E and FIG. 14F and are stopped after operating respective buttons of the first reel stop button 16, the second reel stop button 17 and the third reel stop button 18.

Next, it is determined whether display in stopping the reels constitutes a predetermined prize combination of symbols in reference to the prize symbol combination table (step 129). When the prize is not obtained, the processing returns to the initial step 121 and when the result of the prize determination is replay game, the processing returns to awaiting for operating start lever 15 at step 122 (step 130).

Processing thereafter is similarly carried out in accordance with steps 110 through 114 of the flowchart shown by FIG. 10 explained in the first embodiment.

In this way, also according to the embodiment, the player can know the occurrence of a small hit prize by optically recognizing extinguishing of the back lamps 57*a*, 57*b* and 57*c* of the respective reels 3 through 5 which are normally lighted in operating the start lever 15. Therefore, a small hit prize is previously informed before operating the respective stop buttons 16 through 18 and accordingly, operation of the stop buttons 16 through 18 can be carried out by aiming to stop and display a small hit prize pattern shown by the prize display portion 22.

Further, also according to the embodiment, the informing means is constituted to control to light the respective back lamps 57*a*, 57*b* and 57*c* of the respective reels 3 through 5 by a mode in one-to-one correspondence with the mode of the small hit prize and to announce the kind of the small hit prize to the player. Therefore, the player can know in advance which small hit prize in small hit prizes is provided with high probability of hit and operation of the stop buttons 16 through 18 can be carried out by aiming to stop and display only the prize symbol from the start. Further, the respective back lamps 57*a*, 57*b* and 57*c* are lighted in various modes and therefore, the player can also enjoy the display mode.

Further, the small hit mode is not announced with every result of the inner lottery but announced with predetermined probability by random number lottery using the demonstration lottery tables (refer to FIG. 17 through FIG. 19). Further, there is a case in which a prize mode different from a prize mode determined by the prize mode determining means is announced with predetermined probability. Therefore, the small hit prize mode may be informed to the player or may not be informed thereto. Thus, information of the small hit prize mode is expected by the player and when the small hit prize is informed, the pleasure is enhanced and enjoyment of game is promoted.

Further, also according to the above-described embodiment, it may be constructed such that when a prize mode other than a small hit prize is determined, the small hit prize mode is not announced in advance and only when the small hit prize mode is determined, the small hit prize mode is announced with predetermined probability.

Also by such respective constitution, an effect similar to those in the above-described respective embodiments is achieved.

Further, although an explanation has been given of the case in which the game machine according to the present invention is applied to a slot machine in the above-described embodiments as mentioned above, the present invention is not limited thereto but is applicable to, for example, a pinball game machine such as a pachinko machine or other amusement machines.

When the present invention is applied to a pachinko machine, flow of the game such as operation of the start lever, sampling of a random number for determining a prize mode and starting to rotate reels in the slot machines of the above-described respective embodiments, is replaced by flow of game such as input of pachinko balls to a specified prize hole, sampling of a random number for determining a prize mode and starting to rotate slot machine reels integrated into the pachinko machine. Further, operation of paying out coins which is carried out when symbols of reels are stopped and displayed to constitute a specific mode in the slot machines of the above-described respective embodiments, is replaced by rewarding a special prize in the pachinko game as in providing a large number of balls to the player by opening a variable prize device of attacker or tulip in the pachinko machine.

Although the present invention has been explained in reference to the embodiments, it is apparent for those skilled in the art that many changes and modifications can be made without departing from the spirit and scope of the invention, as clear from the following claims.

What is claimed is:

1. A game machine comprising:

prize mode determining means which determines a prize mode of a game with reference to a probability table comprising data for classifying a drawn random number to a plurality of small hit prize modes and other respective prize modes, and informing means for informing a player of the kind of small hit prize mode determined by a random number lottery with reference to an informing determination table for determining the prize mode to be informed at a predetermined probability determined by the random number lottery with reference to the informing determination table.

2. A game machine according to claim 1:

wherein when a prize mode other than the small hit prize modes is determined by the prize mode determining means, the informing means informs the player of one of the small hit prize modes at the predetermined probability.

3. A game machine according to claim 1:

wherein the informing determination table which is used by said informing means for determining the prize mode to be informed is an informing selection lottery probability table comprising data for classifying the drawn random number into a respective prize mode to be informed.

4. A game machine according to claim 1:

wherein the informing determination table which is used by said informing means for determining the prize mode to be informed is a demonstration lottery table selected with reference to a demonstration lottery table selecting table comprising data for classifying a combination of a game state and the prize mode determined by said prize mode determining means into a respective demonstration lottery table, in accordance with the game state and the prize mode.

5. A game machine according to claim 1:

wherein the prize mode determining means comprises:

random number generating means for generating random numbers in a constant range;

random number sampling means for sampling an arbitrary random number from the random numbers generated by the random number generating means; and random number classifying means for classifying the random number sampled by the random number sampling means to the respective prize modes.

6. A game machine according to claim 1:

wherein the informing means informs the player of the kind of small hit prize modes by emitting a plurality of sounds.

7. A game machine according to claim 1, further comprising:

a plurality of rotating reels with outer peripheries that are illustrated with various patterns for stopping and displaying a combination of the patterns in accordance with the prize mode determined by the prize mode determining means; and a plurality of light sources installed to the respective rotating reels for illuminating the patterns stopped and displayed by the respective rotating reels from a rear side;

wherein the informing means informs the player of the kind of small hit prize modes by lighting and displaying the respective light sources in a plurality of modes.

8. A game machine according to claim 1:

wherein the game machine is a slot machine or a pinball game machine.

* * * * *